US009284963B2

(12) United States Patent
Michael

(10) Patent No.: US 9,284,963 B2
(45) Date of Patent: Mar. 15, 2016

(54) BLOWER ASSEMBLY FOR HAND DRYER, WITH HELMHOLTZ MOTOR MOUNT

(71) Applicant: Robert E. Michael, Farmington Hills, MI (US)

(72) Inventor: Robert E. Michael, Farmington Hills, MI (US)

(73) Assignee: American Dryer, Inc., Livonia, MI (US)

( * ) Notice: Subject to any disclaimer, the term of this patent is extended or adjusted under 35 U.S.C. 154(b) by 378 days.

(21) Appl. No.: 13/769,490

(22) Filed: Feb. 18, 2013

(65) Prior Publication Data

US 2014/0212304 A1 Jul. 31, 2014

Related U.S. Application Data

(63) Continuation-in-part of application No. 13/751,491, filed on Jan. 28, 2013.

(51) Int. Cl.

| | |
|---|---|
| ***F04D 25/08*** | (2006.01) |
| ***F04D 29/62*** | (2006.01) |
| ***F04D 29/66*** | (2006.01) |
| ***A47K 10/48*** | (2006.01) |

(52) U.S. Cl.

CPC ..... *F04D 25/082* (2013.01); *A47K 10/48* (2013.01); *F04D 29/626* (2013.01); *F04D 29/665* (2013.01)

(58) Field of Classification Search

CPC ..... F04D 25/082; F04D 29/665; F04D 13/06; F04D 25/06; F04D 25/08; F04D 29/444; F04D 29/626; A47K 10/48

USPC ..... 417/423.14, 312

See application file for complete search history.

(56) References Cited

U.S. PATENT DOCUMENTS

| | | | | |
|---|---|---|---|---|
| 2,577,809 | A | | 12/1951 | Reeves et al. |
| 3,584,766 | A | | 6/1971 | Hart et al. |
| 3,948,601 | A | | 4/1976 | Fraser et al. |
| 4,596,921 | A | | 6/1986 | Hersh et al. |
| 4,625,119 | A | | 11/1986 | Murdock, III |
| 4,931,261 | A | | 6/1990 | Jacob |
| 5,200,146 | A | | 4/1993 | Goodman |
| 5,459,944 | A | * | 10/1995 | Tatsutani ..... A47K 10/48 34/202 |
| 5,560,120 | A | | 10/1996 | Swanson et al. |
| 6,640,049 | B1 | | 10/2003 | Lee et al. |
| 6,645,435 | B2 | | 11/2003 | Dawson et al. |
| 6,705,428 | B2 | | 3/2004 | Kudernatsch |
| 6,730,238 | B2 | | 5/2004 | Li et al. |
| 6,874,697 | B2 | | 4/2005 | Callueng |
| 7,878,371 | B2 | | 2/2011 | Sassoon |
| 7,946,055 | B2 | | 5/2011 | Churchill et al. |

(Continued)

FOREIGN PATENT DOCUMENTS

| | | |
|---|---|---|
| EP | 2327327 A1 | 6/2011 |
| WO | 2007067924 A2 | 6/2007 |

OTHER PUBLICATIONS

International Search Report mailed Mar. 28, 2013 (PCT/US2013/023528).

*Primary Examiner* — Justin Jonaitis
*Assistant Examiner* — Christopher Brunjes
(74) *Attorney, Agent, or Firm* — Dickinson Wright PLLC

(57) ABSTRACT

A dryer with a modular blower assembly that allows easy assembly and field servicing through replacement of the blower assembly as a unit. The blower assembly generally includes unique motor mounts that allow a motor assembly to be secured within a housing without being directly fastened to other members.

31 Claims, 16 Drawing Sheets

(56) References Cited

U.S. PATENT DOCUMENTS

| | | | | |
|---|---|---|---|---|
| 7,989,779 | B1 | 8/2011 | Ray et al. | |
| 8,037,691 | B2 | 10/2011 | Commaret et al. | |
| 8,064,756 | B2 | 11/2011 | Liu | |
| D661,023 | S | 5/2012 | Liu et al. | |
| 2004/0026530 | A1 | 2/2004 | Callueng | |
| 2006/0244386 | A1 | 11/2006 | Hooke et al. | |
| 2006/0272673 | A1 | 12/2006 | Kurunczi | |
| 2007/0025848 | A1* | 2/2007 | Shawcross | A47K 10/48 415/208.2 |
| 2010/0247389 | A1 | 9/2010 | Abate | |
| 2010/0254853 | A1 | 10/2010 | Lee et al. | |
| 2010/0296799 | A1* | 11/2010 | Liu | A47K 10/48 392/380 |
| 2011/0116967 | A1 | 5/2011 | Roy et al. | |
| 2011/0277342 | A1 | 11/2011 | Ishii et al. | |
| 2012/0285033 | A1 | 11/2012 | Hsu | |
| 2013/0025045 | A1 | 1/2013 | Gagnon et al. | |
| 2013/0031799 | A1 | 2/2013 | Gagnon et al. | |
| 2014/0216460 | A1* | 8/2014 | Bothma | A61M 16/0066 128/204.18 |

* cited by examiner

BLOWER ASSEMBLY FOR HAND DRYER, WITH HELMHOLTZ MOTOR MOUNT

CROSS REFERENCE TO RELATED APPLICATIONS

This Continuation-In-Part Patent Application claims priority to U.S. patent application Ser. No. 13/751,491 filed Jan. 28, 2013, the entire disclosure of the application being considered part of the disclosure of this application, and hereby incorporated by reference.

BACKGROUND OF THE INVENTION

1. Field of the Invention

The present invention is generally directed to a dryer with a modular blower assembly that allows easy assembly and easy field servicing through replacement of the blower assembly as a unit.

2. Description of the Prior Art

Wall or surface mounted dryers have been used for many years in washrooms for drying a person's hands. Originally, most of these dryers used low velocity air, causing the drying process of the hands to be fairly slow. To speed up the drying process, many manufacturers created high-speed or high velocity hand dryers. As the velocity of the air increased, the noise level also increased. In certain high usage situations, such as airports and sporting facilities, the noise from high-speed hand dryers could be exceptionally loud and propagate well beyond the washrooms. Currently manufacturers have had little success in reducing the noise level of hand dryers without negatively affecting the performance.

Currently, in the United States, the ADA requires that protruding objects with leading edges of more than 27 inches and not more than 80 inches above the finished floor or ground shall not protrude more than 4 inches maximum horizontally into a circulation pathway, such as a hallway or passageway. Many facilities also have substantial design limitations where hand dryers may actually be installed, including when considering the flow of people entering and exiting a washroom. Currently, all traditional hand dryers mounted to walls must be mounted much higher than 27 inches from the ground to be functional, leaving only two options to meet ADA requirements. The first option is to recess the dryer into the wall so that it protrudes less than 4 inches while the second option is to use a low-profile dryer having a complete thickness when mounted of less than 4 inches. Low-profile hand dryers having a thickness of less than 4 inches are expensive when compared to traditional hand dryers and are not capable of providing high-speed air drying. Furthermore, low-profile hand dryers are difficult to use, as a user typically needs to place their hands extremely close to the supporting surfaces to insert them into the air stream. Given the positioning of the hands, the user typically contacts the wall at least once during the drying process. Hand dryers recessed into the wall are also problematic as most facility managers avoid any major modifications to the walls of a washroom. Currently, there are no hand dryers that provide compact, low-profile, ADA compliant, surface mounted hand dryers.

The blower assembly of many hand dryers is formed out of a variety of components and is typically difficult to assemble. For example, each of the components is typically attached through some fastening mechanism to the other components and then installed inside a hand dryer. The method of assembly also makes it difficult to field service dryers as a specialized electrician must be called because the electronics and components making the blower assembly are all installed in various locations within the shell of the dryer creating potential hazards for non-electricians. Therefore, field servicing of hand dryers is typically expensive, or the complete dryer unit must be replaced. Many times, the problem with complete replacement is that the new dryer does not match the old dryer and extensive rewiring of the facility or structural renovations must be performed to accommodate the new dryer. During this time period, the washroom may be without an operational hand dryer which for smaller washrooms having at most one hand dryer creates potential issues. Therefore, it is undesirable for the hand dryer to be non-operational for any period of time as well as it is undesirable to require a skilled electrician to service the unit. In addition, requiring a skilled electrician to service the unit may lengthen the time until a service call may be performed.

SUMMARY OF THE INVENTION

The present invention is generally directed to a dryer with modular blower assembly that may be mounted on a contoured backplate that allows for a low-profile dryer having an outer contoured surface with a cavity to place the hands between the blower assembly and the air outlet assembly. More specifically, the present invention provides an easily assembled, easily serviced dryer having a modular blower assembly that is capable of being interchangeably used in a variety of settings.

The present invention is more specifically directed to a dryer assembly for mounting to a support structure having an electrical service, wherein the dryer assembly includes a backplate configured to mount to the support structure and defining an air channel. The backplate may be viewed as having an upper portion, a middle portion, and a lower portion and the air channel extends from the lower portion through the middle portion and to the upper portion. The lower portion may define a blower inlet in fluid communication with the air channel and the upper portion may define an air outlet in fluid communication with the air channel.

The air channel includes a longitudinal portion and a lateral portion extending therefrom. The lateral portion is located in the upper portion and defines the air outlet, and the blower inlet is defined by the longitudinal portion.

The backplate further includes an outer perimeter having a first longitudinal side approximately aligned with a second longitudinal side and first and second lateral sides extending between the longitudinal sides. The longitudinal sides are greater in length than the lateral sides and the air channel includes a longitudinal portion aligned with the longitudinal sides. The lateral sides each have a length and wherein the longitudinal portion is located within 25% of the length of the lateral side from the longitudinal side, although if the longitudinal side bows outwardly, it may be greater, or inwardly, it may be less.

The air channel cooperatively includes a first chamber in the lower portion, a second chamber in the upper portion and an air passageway extending there between in the middle portion. The second chamber has a volume that is greater than the volume of the first chamber. In addition, the air passage may have a lateral cross sectional area less than the lateral cross sectional areas of each of the first chamber and the second chambers. As the air is fluidly channeled through the air channel from the blower inlet to the air outlet, the configuration of the air channel allows an increase velocity of the air as it moves from the first chamber to the air passage and decrease velocity of the air as it moves from the air passage to the second chamber. More specifically, the air channel is configured to ensure that during operation the air inlet chamber has a higher velocity of air than the air outlet chamber under a constant supply of air through the blower inlet.

The air channel includes a first chamber having walls defining the blower inlet and the walls are configured to sealing receive a gasket having a laterally extending opening in fluid communication with the first chamber. The gasket is also configured to sealingly engage a blower assembly.

The backplate includes a first surface and a second surface bounded by an outer perimeter. An outer lip extends on the second surface away from the first surface, and the air channel protrudes from the first surface. The second surface defines a first chamber, a second chamber and an air passage of the air channel and wherein the blower inlet and the air outlet each form a passage between the first and second surfaces. The outer lip includes an outer edge having a substantially planar surface configured to mount against the support structure.

The outer lip may include a number of interruptions, such as at least one attachment feature, and the at least one electrical passage. The dryer may also include an outer cover configured to engage the outer lip for a substantial portion of the outer perimeter. The outer cover is more specifically configured to sealingly engage the backplate to ensure that air passing through the blower assembly first passes through the optional filter, if the dryer is equipped with a filter.

The backplate may further include a plurality of attachment locators configured to allow attachment of the backplate to the support structure. The attachment locators generally include a raised surface on the second surface and wherein the raised surface is in substantially planar alignment with the outer edge. The second surface may also include at least one recessed portion relative to the outer edge. The recessed portions are at least a 5 mm recessed, preferably at least 10 mm recessed and more preferably at least 12 mm recessed relative to the outer edge, however it is expected that the bulk of the backplate will be within 25 mm of height relative to the outer edge. The recessed portions may include portions of the second surface proximate to an electrical box on the first surface. In addition, the recessed portions of the second surface form a wall cavity when mounted on the supporting surface and allow power to be routed from the electrical service to the electrical box without drilling holes between the first and second sides other than within the area defined by the first surface within the walls of the electrical box.

The present invention may further include a backplate wherein an outer lip extends on the second surface away from the first surface and wherein the second surface defines an electrical passage having a concave surface extending from the outer lip to an area proximate to an electrical box located on the first surface. The electrical box defines a hole between the first surface and the second surface.

The air outlet is defined by edges and wherein the edges are configured to sealingly receive an air nozzle.

The backplate may include a first large opening forming at least 10% of the area of the backplate in the middle portion, and a second large opening forming at least 5% the area of the backplate in the lower portion.

The present invention may be further directed to a dryer assembly for mounting to a support structure having an electrical service, the dryer assembly including a backplate configured to mount to the support structure, wherein the backplate has a first surface and an opposing second surface configured to face the support structure. The backplate defines a blower inlet extending between the first and second surfaces and an air outlet extending between the first and second surface, and an air channel defined by the backplate extends between the blower inlet and the air outlet. A blower assembly is in fluid communication with the air channel.

The dryer assembly further includes a cover plate and the air channel is a cavity defined by the second surface of the backplate. The cover plate seals the cavity from the second surface. The air channel includes an air inlet chamber proximate to the blower inlet and an air outlet chamber proximate to the air outlet and an air passageway extending between the air inlet chamber and the air outlet chamber and wherein the air passageway has a smaller lateral cross sectional area than the lateral cross sectional area of the air inlet chamber and the air outlet chamber.

The backplate includes an integral electric box having walls and a conduit passage extending between the electric box and an edge of the backplate. The backplate further includes attachment features and is bounded by an outer perimeter and wherein an outer lip extends on the second surface away from the first surface, and wherein the air channel protrudes from the first surface and wherein the outer lip includes an outer edge having a substantially planar surface configured to mount against the support structure. The attachment features include a surface in substantial planar alignment with the planar surface. The backplate may further include a contoured recess on the first surface proximate to the blower assembly.

The present invention further is directed to a dryer assembly for mounting to a support structure having an electrical service, the dryer assembly including, a backplate configured to mount to the support structure, the backplate having an outer perimeter bounding a first surface and an opposing second surface and wherein the second surface is configured to face the support structure and wherein the backplate defines a blower inlet extending between the first and second surfaces and an air outlet extending between the first and second surface; an air channel defined by the backplate and extending between the blower inlet and the air outlet; a blower assembly in fluid communication with the air channel; and an electrical box integrally formed on the backplate and an electrical passage formed on the backplate extending between the electrical box and the outer perimeter. The second surface is configured to be for its majority spaced at least 10 mm from the support structure.

The present invention is further directed to a blower assembly for a dryer assembly configured to dry hands. The blower assembly includes at least a blower housing, a motor mount and a motor assembly. The blower housing has a base and an outer wall collectively defining a blower cavity with a blower cavity diameter. The blower cavity is substantially aligned along on operational axis and at least one of the base and the outer wall includes at least one air inlet. The motor mount has a motor mount diameter and the motor mount is configured to be received in the blower cavity. The motor assembly includes a motor and a blower and wherein the motor and blower are at least partially enclosed in an outer casing having an air inlet and an air outlet and wherein the outer casing sealingly engages the motor mount between the air outlet and the air inlet.

The motor mount is approximately equal to and less than the blower cavity diameter, and a diffuser plate may be included between the base and the motor mount. The diffuser plate includes directional air fins, wherein a plurality of the directional air fins each includes at least one arcuate profile. The diffuser plate includes a diffuser passage aligned substantially about the operation axis.

The motor mount is formed from a compliant material such that when the blower assembly is in an assembled state, the motor assembly is mounted in compression against the motor mount in the blower housing. The motor mount when assembled engages a diffuser plate on a first side and the motor assembly on an opposing second side and wherein the motor mount includes an outer circumferential surface engaging the blower housing. The motor mount includes a motor mount air passage substantially aligned along the operational axis. It is expected that the motor mount includes at least one Helmholtz resonator, preferable at least six Helmholtz resonators, each extending radially outward from the operational axis. Each Helmholtz resonator includes a neck and a chamber and wherein the neck opens to a motor mount air passage aligned with the operational axis.

The blower assembly has the air inlet arranged along the operation axis and the air outlet is defined by openings on the outer casing. The air exits through the air outlets, flowing outwardly away from operational axis. The motor assembly is configured to pull air through the air inlet along the operational axis, compress the air through a motor portion on the motor assembly and expel the air outwardly away from the operational axis.

The outer casing includes a motor portion and a blower portion and wherein the motor mount sealing engages the blower portion and the motor portion includes at least one motor assembly anti-rotation key. The blower assembly further includes an outlet motor mount wherein the outlet motor mount includes a motor mount anti-rotation key configured to engage the motor assembly anti rotation key. The outlet motor mount is held in compression against the outer casing.

A housing end cap includes protrusions engaging recesses on the outlet motor mount and wherein the housing end cap is configured to prevent the outlet motor mount from rotating relative to the blower housing and wherein the outlet motor mount is configured to prevent the motor assembly from rotating relative to the blower housing. The housing end cap is configured to be coupled to the blower housing and includes an end cap air outlet, and wherein the blower housing is capable of being coupled to an end cap and wherein the motor assembly is not directly coupled to the housing.

The motor assembly is coupled to the housing solely by being held in compression between the motor mount and the outlet motor mount. The outer casing is free of external attachment mechanisms, and the motor mount is free of attachment mechanisms. The motor mount is not coupled to the housing with attachment mechanisms. The motor mount is compressed in an assembled state and engages the housing in a friction fit. The motor mount includes an air inlet side and an air outlet side and the air outlet side defines a cavity capable of receiving a portion of the motor assembly.

The cavity on the motor mount is defined by sidewalls, and the motor assembly includes a blower portion and a motor portion and wherein the sidewalls extend between the blower portion and the blower housing. The air outlet motor mount does not engage the blower housing, instead the air outlet motor mount directly engages the motor assembly, a housing end cap and a heater element holder located between the outlet motor mount and the housing end cap.

The housing end cap is coupled to the blower housing and wherein the housing end cap includes a plurality of protrusions, each having a gap between two adjoining protrusions. The blower housing is coupled to the backplate and an air outlet extends into the backplate, more specifically, the outlet extends through a compliant member into a channel that extends to an air outlet.

The present invention is directed to a blower assembly for a dryer assembly configured to dry hands. The blower assembly includes a blower housing having a base and an outer wall collectively defining a blower cavity with a blower cavity diameter. The blower cavity is substantially aligned along on operational axis, and the base includes at least one air inlet. The motor mount has a motor mount diameter and is configured to be received in the blower cavity. The motor assembly has an outer casing defining air inlet and an air outlet and wherein the motor assembly is isolated from the blower housing and does not directly contact the blower housing. The first motor mount and the second motor mount are located on opposing ends of the motor assembly and aligned with the operational axis, preferably with the operational axis pass through near the center of each.

The present invention further is direct to a blower assembly including a blower housing having a base and an outer wall collectively defining a blower cavity with a blower cavity diameter. The blower cavity is substantially aligned along on an operational axis and the base includes at least one air inlet. A motor mount having a motor mount diameter is configured to be received in the blower cavity and includes a motor mount passage. A diffuser plate is located between the base and the motor mount and includes a diffuser passage aligned with the motor mount passage. The motor assembly has an outer casing defining air inlet and an air outlet. The air inlet is aligned with the motor mount passage and the air outlet is not. A second motor mount is located on an opposing side of the motor assembly from the motor mount.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
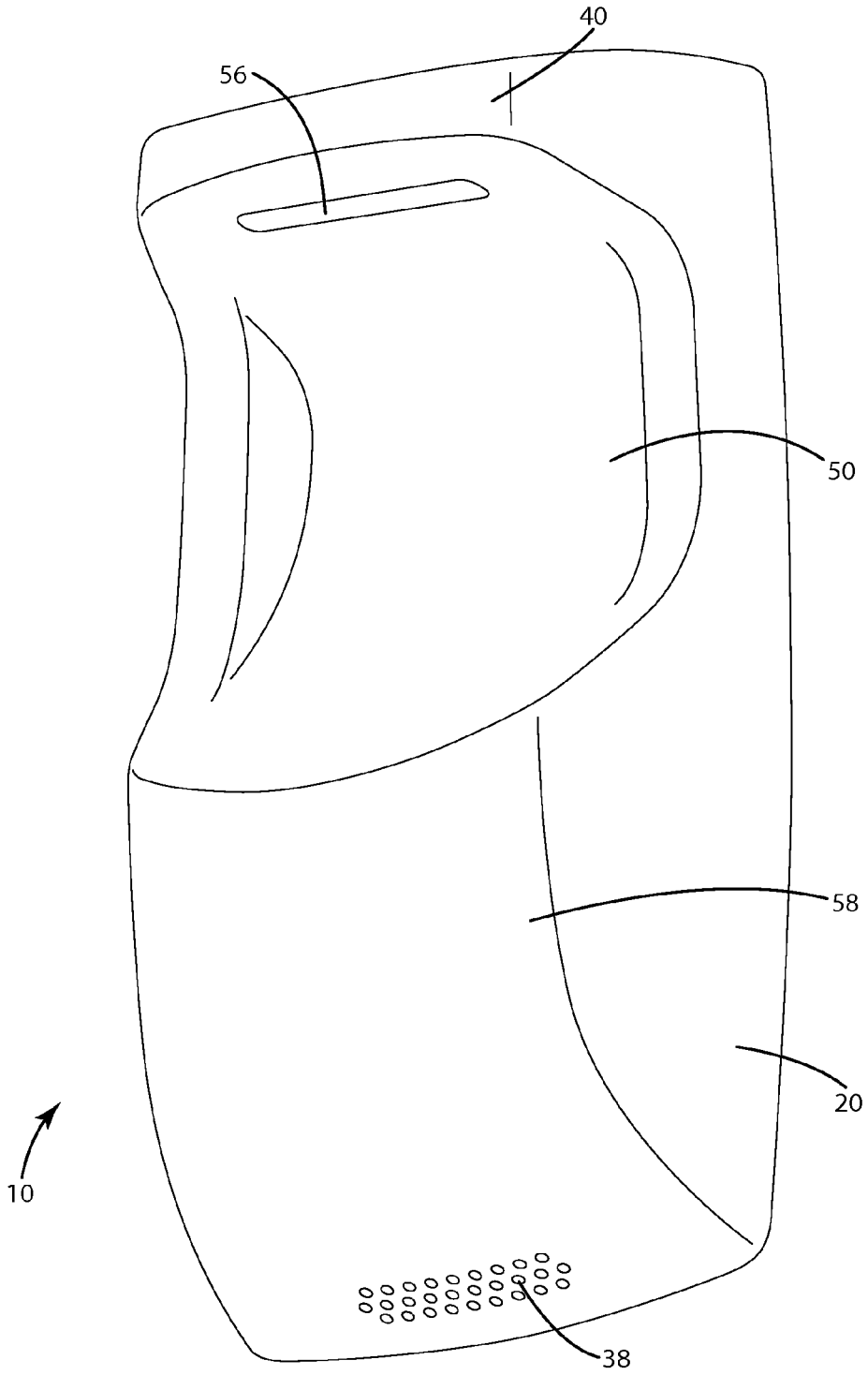
FIG. 1 is a front right perspective view of a dryer having a splash guard including an integrated blower assembly.
Figure 20:
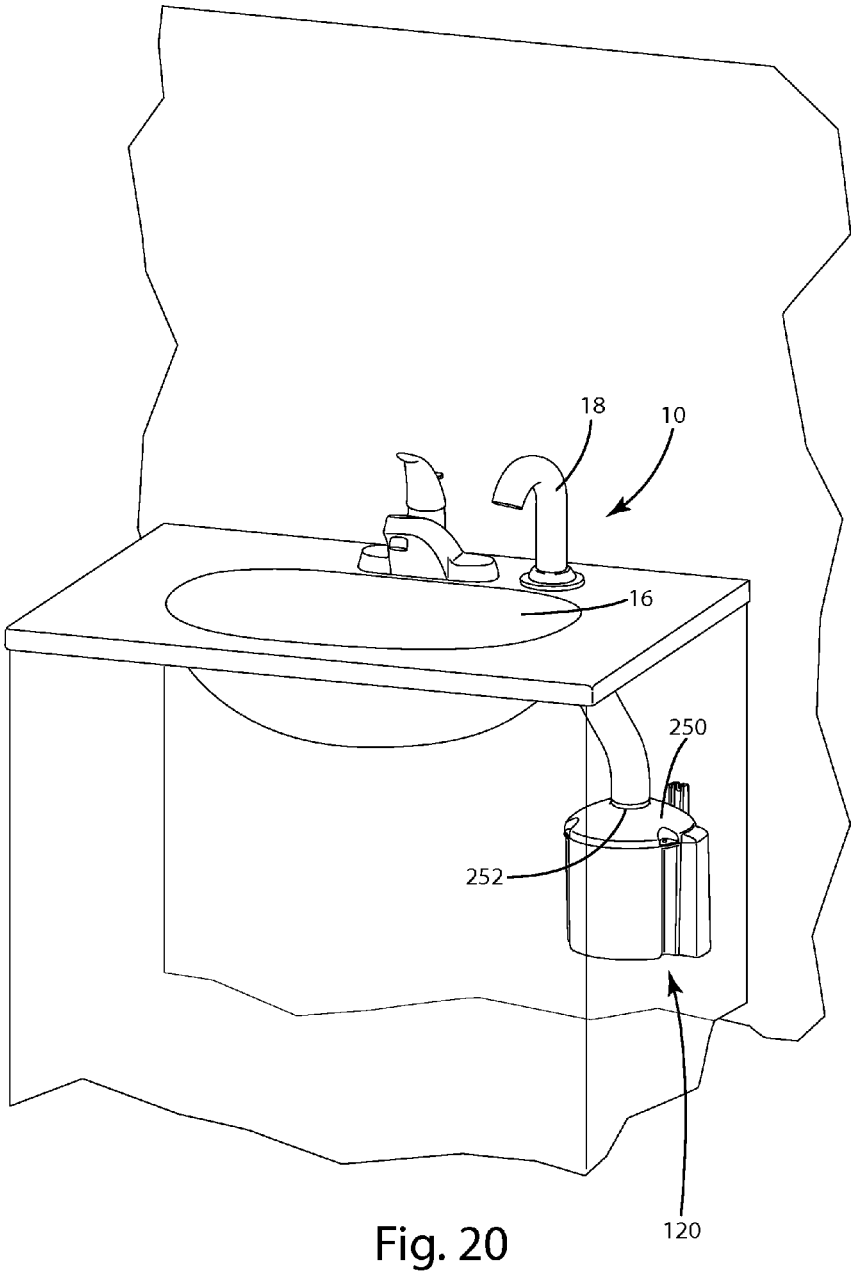
FIG. 20 is a front perspective view of a counter top dryer using the modular blower assembly.

The present invention is generally directed to blower assemblies 120 for dryers 10 that are configured to be mounted on a supporting structure 12 such as a wall or under a sink. These dryers or dryer assemblies 10 are typically mounted in washrooms, locker rooms and the like. The dryer assemblies 10 as illustrated in FIG. 1 generally include an outer shell 20, a blower assembly 120 set within the outer shell and the backplate 30 for mounting the dryer assembly 10 on the supporting structure 12. Another version of a dryer 10 is illustrated in FIG. 20 using the same modular blower assembly 120 which may be mounted under or proximate to a sink 16 with a nozzle outlet 18.

As illustrated in FIG. 1, a dryer 10 has an outer shell 20 and generally includes a contoured outer surface 30 having an air inlet 38 and an air outlet 56. The blower assembly 120, as illustrated in FIG. 1, draws in air through the air inlet 38, passes it through the backplate 300 to the air outlet 56. In the exemplary dryer assembly 10 illustrated in FIGS. 1 and 2, the user would place their hands under the air outlet 56 proximate to the evaporation surface 60, which forms an indentation on the contoured outer surface 30. It should be recognized that the outer shell 20 may be formed in a variety of sizes, shapes, styles, and configurations, even as illustrated in FIG. 20. The dryer assembly 10 of the present invention may be generally configured to have the blower assembly 120 located on the opposing side of the air outlet 56 relative to the area where the user would place their hands for drying, such as the illustrated evaporation surface 60 or the blower assembly 120 located remotely from the air outlet. Typically, traditional dryers would have a blower assembly configured such that the air outlet is directly proximate and in line with the blower assembly, such that the whole dryer unit is located on one side of the hands such as above or below the hands. In contrast, the present invention through locating the blower assembly 120 and air outlet 56 on opposing sides of the operator's hands or remotely from the air nozzle, allows for a uniquely shaped, efficient, low-profile, and ADA compliant hand dryer for location in circulation pathways. The configuration of the outer shell 20, blower assembly 120, and air outlet 56 is more specifically illustrated in FIGS. 2 and 20.

Figure 2:
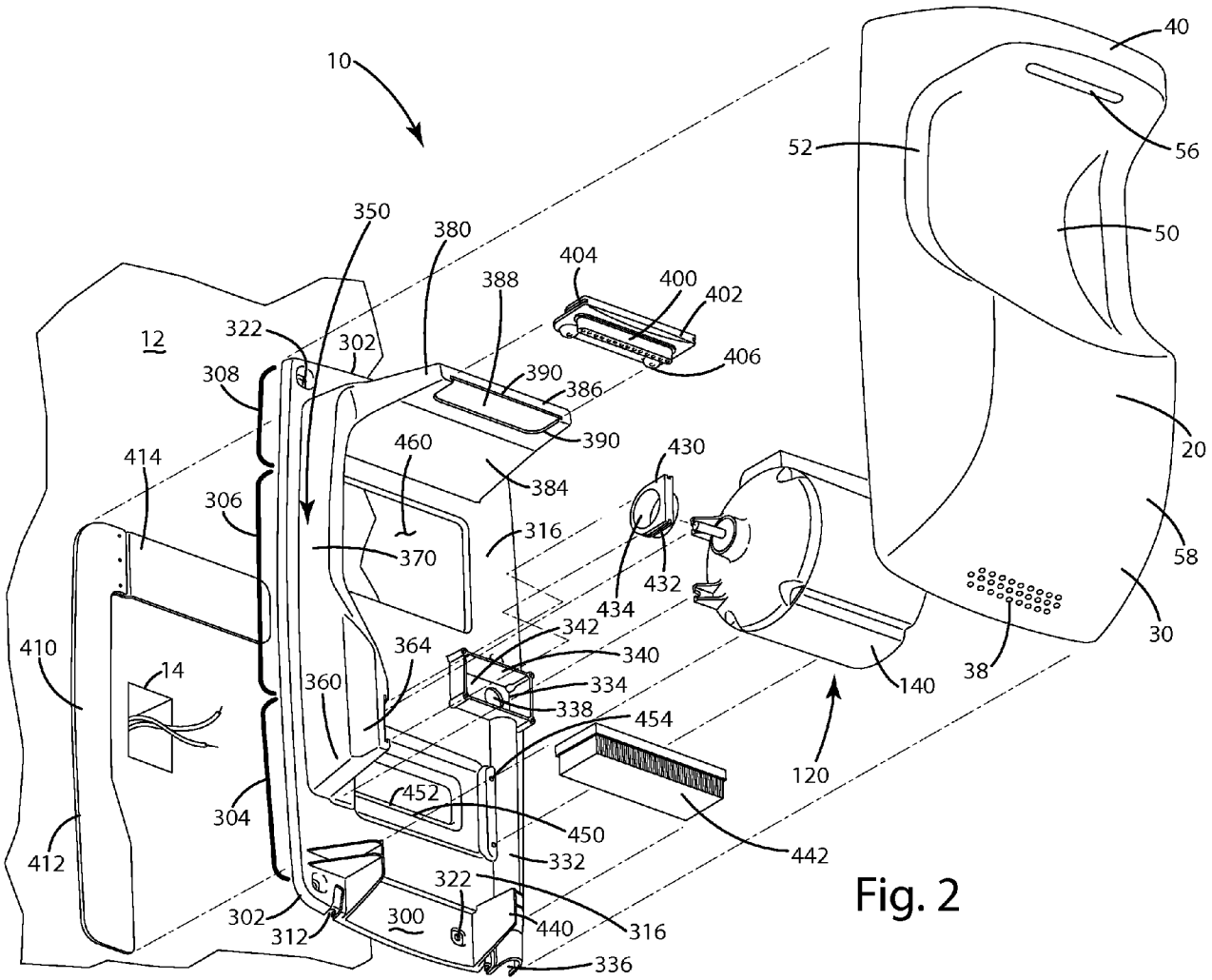
FIG. 2 is an exploded perspective view of the dryer in FIG. 1.

The dryer 10 as illustrated in FIG. 1 generally can be divided into three major portions, with reference to the outer shell 20. The upper portion 40 generally includes an air outlet 56 extending outward from the supporting surface 12. The adjacent middle portion 50 is located on the contoured outer surface 30, where the surface contours inward, creating an area for the user to place their hands under the air outlet 56. The lower portion 58 generally includes an outward bulge from the supporting surface 12, to allow sufficient room for the blower assembly 120 in the cavity created by the outer shell 20, as illustrated in FIG. 2.

The present invention may use a unique backplate 300 that allows a contoured one-piece member to channel air from a modular blower assembly 120 to air outlet 56 with minimal assembly and space-saving configuration. More specifically, it is very difficult to provide a dryer 10 where the blower assembly 120 is located on the opposite side of the air outlet 56 of where the user places their hands for drying, without using expensive, hard to assemble tubing, while maintaining sufficient airflow between the blower assembly 120 and the air outlet 56. As the high-speed air passing through the tubing has fluid characteristics, the tubing itself creates design limitations on how much and how fast the air can flow through, while also minimizing the power requirements of the blower assembly 120. For a dryer 10, as illustrated in FIGS. 1 and 2, having an outer contoured surface 30 as illustrated, it is almost impossible to channel air from the blower assembly 120 to the air outlet 56 with the use of tubing, as the outer shell 20 would substantially minimize the cross sectional area of any such tubing. More specifically, it would not only be difficult to assemble given the minimal space, particularly in the middle portion 50, but any type of tubing or separate channels routing the air would be susceptible to reduced air output, particularly with high-speed air dryers. For the dryer 10 illustrated in FIG. 20, the modular blower assembly 120 allows close placement to the outlet to minimize the length of any tubing and larger diameter tubing.

The novel backplate 300 allows for easy assembly and improved fluid transfer of the air between the blower assembly 120 and air outlets 56, 388. In addition, the backplate 300 is also specifically configured to allow for easy replacement of existing dryers by having areas that sit proud of the supporting structure 12, when the dryer assembly 10 is mounted on the supporting structure 12, thereby allowing easy routing of power from an electrical service 14 to an integral electrical box 334 on the backplate 300. The backplate 300 also works in conjunction with the modular blower assembly 120 for easy assembly.

The backplate 300 also has an integrally formed air channel 350 that is also specifically configured to induce velocity changes in the fluid movement of the air through the air channel and thereby reduce the noise emitted by an operational dryer 10. The air channel 350 may be divided into three distinct areas, specifically an air entrance chamber 360, an air passageway 370 and an air outlet chamber 380, each having different volumes and cross sectional areas to provide improved airflow and reduced noise. One current issue with high-speed dryers is that the noise, particularly when multiple dryers operate in a washroom having hard surfaces, the combined noise can be extremely loud. The configuration of the backplate 300 and specifically the air channel 350 on the backplate 300 as well as the modular blower assembly 120 all work to reduce any noise.

The backplate 300 is expected to be formed out of a composite material. For example, the backplate may be injection molded with all of the illustrated features directly formed on the backplate 300 for easy assembly. The backplate 300 may be formed out of a semi-crystalline polybutylene terephthalate material, which provides the desired structural rigidity, is heat resistive, and includes sound absorbing properties. More specifically, the backplate 300 is preferably formed out of a heat resistive material having acoustic impedance. Of course, the backplate 300 may be formed from other materials, such as Acrylonitrile butadiene styrene or polycarbonate.

The backplate 300 generally includes an outer perimeter 302 having longitudinal sides and lateral sides extending between the longitudinal sides. The longitudinal sides are illustrated as having an arcuate shape and being a mirror image of each other, however they may have any size, shape, or configuration.

The backplate 300 may also be generally divided for reference into a lower portion 304, a middle portion 306 and an upper portion 308, similar to the lower portion 58, middle portion 50, upper portion 40 over the overall dryer 10 and outer shell 20. The lower portion 304 is generally where the blower assembly 120 is located and coupled to the backplate 300, as well as the air entrance chamber 360. The middle portion 306 is approximately located where the user, proximate to the outer shell 20, would place their hands. The backplate 300 further includes an upper portion 308 which includes the air outlet opening 388, which would be aligned with the air outlet 56 on the outer shell 20.

The lower portion 304 of the backplate 300 is primarily configured to receive the blower assembly 120 as well as include the air entrance chamber 360 having a blower inlet 362. Of course, the lower portion 304 includes a number of additional unique features that improve assembly of the dryer 10 as well mounting of the dryer assembly 10 to a supporting structure 12. Starting at the lower edge of the outer perimeter 302, the lower portion 304 includes at least one lower attachment mechanism 312 to allow for easy attachment of the outer shell 20 to the backplate 300 once the backplate 300 is mounted to the support structure 12 using the attachment locaters 322. Furthermore, the lower portion includes an electrical passage entrance 332 and at least a portion of a conduit passage 336 extending to the electrical box 334. While the illustrated outer shell 20 does not include a conduit entrance, it may be configured to be easily cut, including markings for cutting, or even be molded such that the installer could easily snap a portion out of the outer shell 20.

It should be recognized through all of the descriptions and illustrated Figures that the items on the backplate 300 may be reversed, such as mirror-image of each other. More specifically, while viewing the front of the backplate 300, the electric box 334 is illustrated as being on the right side and the air channel 350 is illustrated on the left. These items may be reversed as a mirror-image of each other with the electric box 334 on the left and the air channel 350 on the right. Of course, the lower portion 304, similar to the middle portion 306 and upper portion 308, includes a variety of attachment locators 322 which are discussed in more detail below. The lower portion 304 may also include filter brackets 440 to receive an optional filter 442. To minimize the number of different parts and assembly, it is expected that the filter brackets 440 will be present on backplates 300 such that the end user can add a filter 442 whenever desired.

The backplate 300 may be viewed as having two opposing surfaces, specifically a first surface 314 and a second surface or wall surface 310. The first surface 314 includes the filter brackets 440, electric box 334, and the raised air channel 350. Of course, as illustrated in Figures, the second surface or wall surface 310 actually defines the passage through which the air passes in the air channel 350. Therefore, the first surface defines the outer walls of the air channel 350 as well as the blower inlet 362 and air outlet opening 388.

Figure 10:
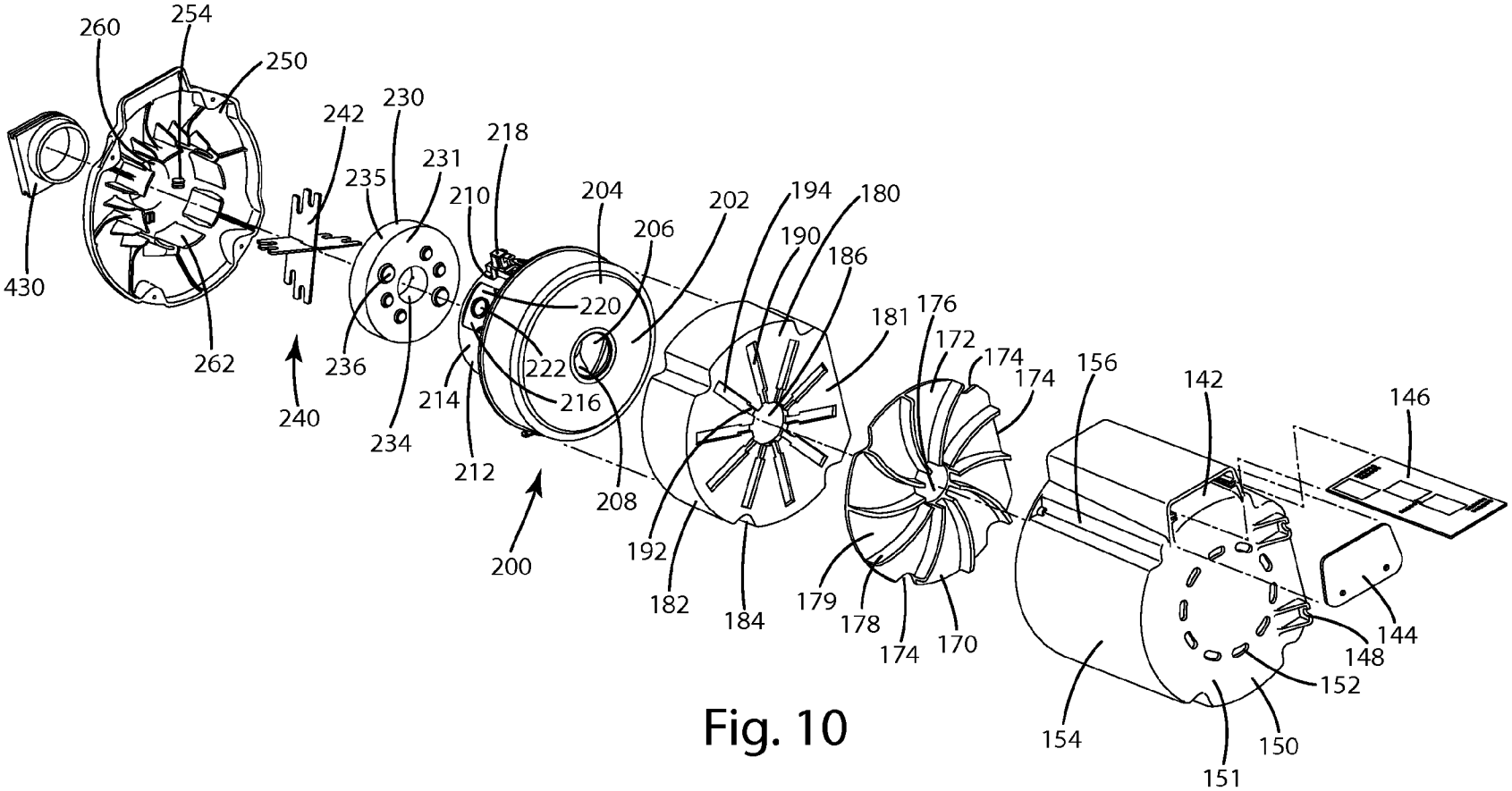
FIG. 10 is an exploded perspective view of a blower assembly.

The lower portion 304 also includes a blower mount area 450 which is recessed relative to a substantially planar portion 316 of the backplate 300. The blower mount area 450 includes attachment areas 458 to which the illustrated blower mounts 148 on the housing 140 of the blower assembly 120 attach. This allows the blower assembly 120 to be securely fastened to the backplate 300. Given the illustrated predominantly round nature of the blower assembly 120, particularly the motor assembly 200 enclosed therein as illustrated in FIGS. 2 and 10, the blower mount area 450 may include a recessed area 452 to place the housing 140 of the blower assembly 120 as close to the supporting structure 12 as possible. As illustrated in FIG. 2, the backplate 300 may even include an opening 454 to further mount the blower assembly 120 as close as possible to the supporting structure 12. The opening 454 allows the housing 140 of the blower assembly 120 to extend beyond the first surface 344, specifically as close as possible to the supporting structure 12, thereby providing as compact of a dryer unit as possible. More specifically, the closer the blower assembly 120 may be mounted to the supporting structure 12, the more compact the underlying assembly, minimizing the distance the outer shell 20, specifically the outer contoured surface 30, protrudes from the wall or supporting structure 12. The backplate 300 may further include a mounting surface 456 surrounding the opening to which a mounting surface 140 on the blower housing 158 rests after being assembled to the backplate.

The lower portion 304 of the backplate 300 includes a portion of the air channel 350, specifically the air entrance chamber 360. As illustrated in FIG. 2, the walls 364 defining the blower inlet 362 are defined by the first surface 314. The blower inlet 362 as illustrated in FIG. 2 is configured to receive a gasket 430 including a slot 432. The slot 432 is configured to sealingly engage and receive the edges of the wall 364. The gasket 430 is expected to be made out of a compliant material and includes an opening 434 which sealingly engages an outlet on the blower assembly 120, specifically the reducing neck 252. The gasket 430 being formed of a compliant material allows for tolerance differences between the blower assembly 120 and backplate 300 during installation and thereby allows for easy assembly. The gasket 430 being formed out of a compliant material also ensures that vibrations in the blower assembly 120 do not transmit to the backplate 300. The opening 434 on the gasket 430 is illustrated as being axially aligned with the axial rotation of the blower assembly 120. As such, the air exits the end of the blower assembly 120 and is directed into the air entrance chamber 360 substantially perpendicular to the air channel 350 at that point, particularly the longitudinal portion 352 of the air channel 350.

The air channel 350 may be generally broken into two portions, a longitudinal portion 352 extending from the lower portion 304 to the upper portion 308, and a lateral portion 354 extending from the longitudinal portion. The air entrance chamber 360 and air passageway 370 are defined by the longitudinal portion 352 of the air channel 350 and the bulk of the lateral portion 354 substantially defines the air outlet chamber 380.

The size, shape, style, and configuration of the air entrance chamber 360, air passageway 370, and air outlet chamber 370 may vary, however it has been found that noise of the dryer during operation is reduced if the air entrance chamber 360 has a smaller overall volume than the air outlet chamber 380. The air entrance chamber 360 may also be seen in FIG. 3 and how the cavity formed on the second surface 310 narrows and is reduced in cross-sectional area as it extends through a passage 370 in the middle portion 306 between the air entrance chamber 360 and air outlet chamber 380. As such, the air inlet chamber 360 would have a higher velocity than the air outlet chamber 380.

Figure 3:
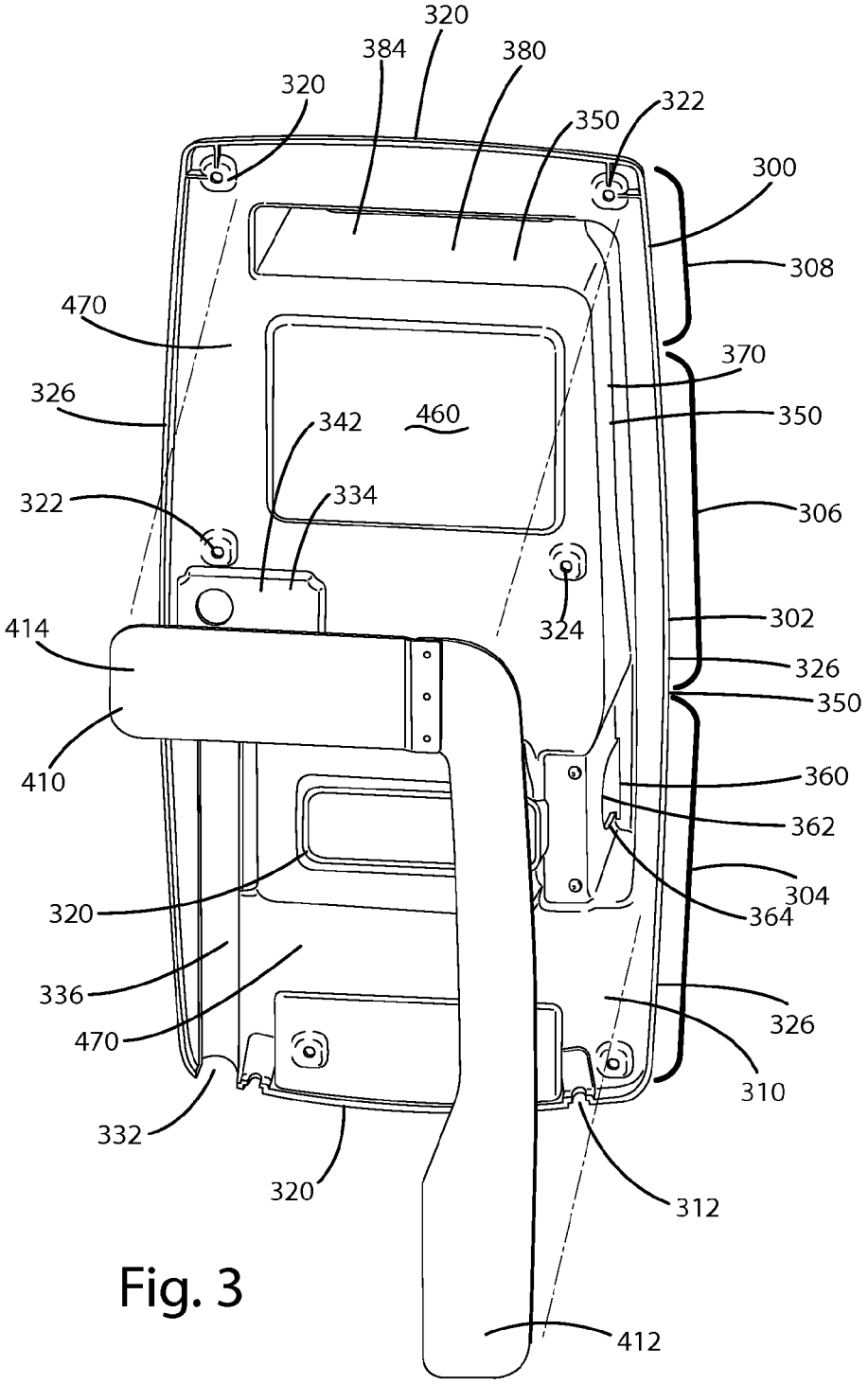
FIG. 3 is a rear perspective view of the backplate.
Figure 4:
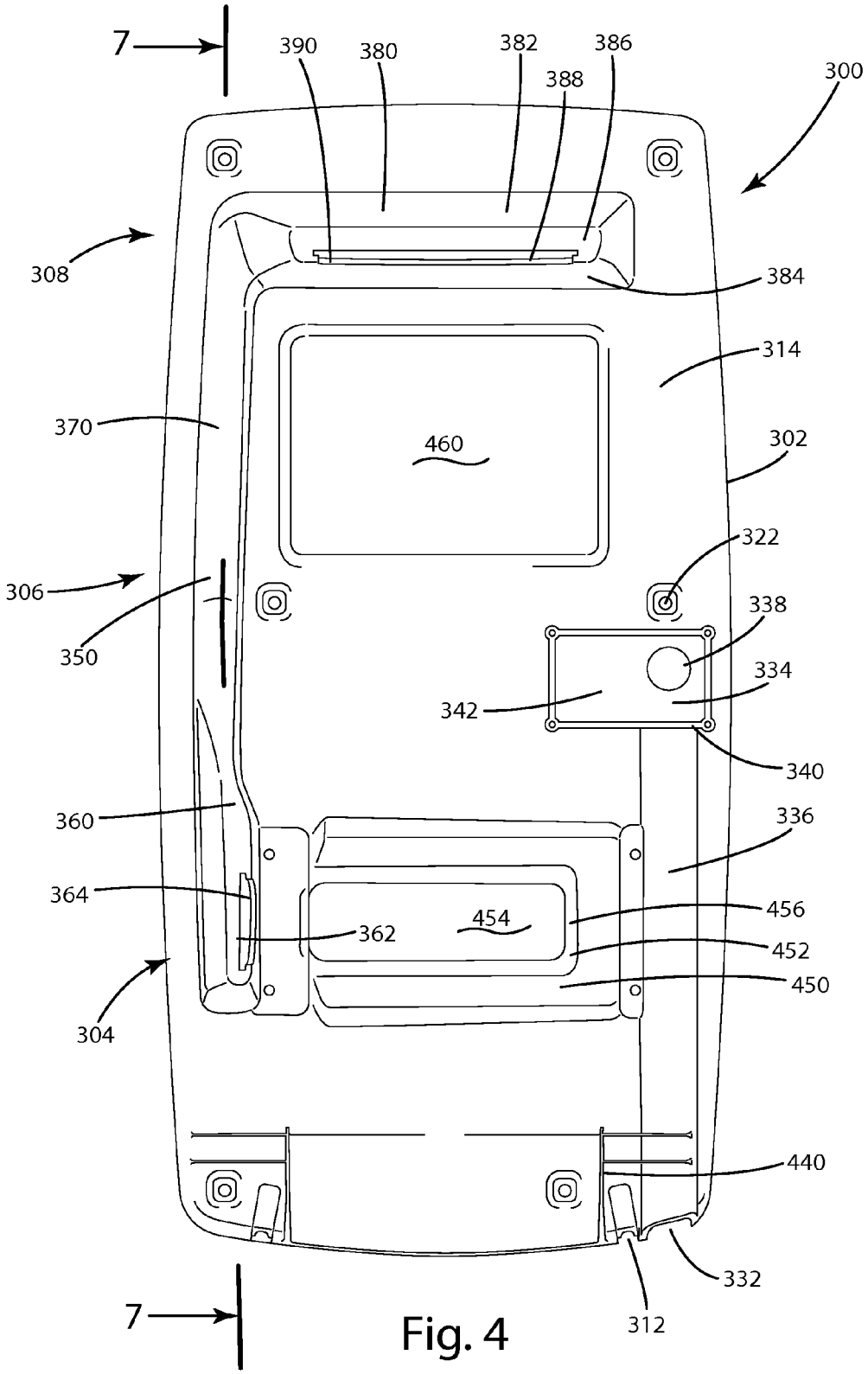
FIG. 4 is a front elevational view of the backplate.
Figure 5:
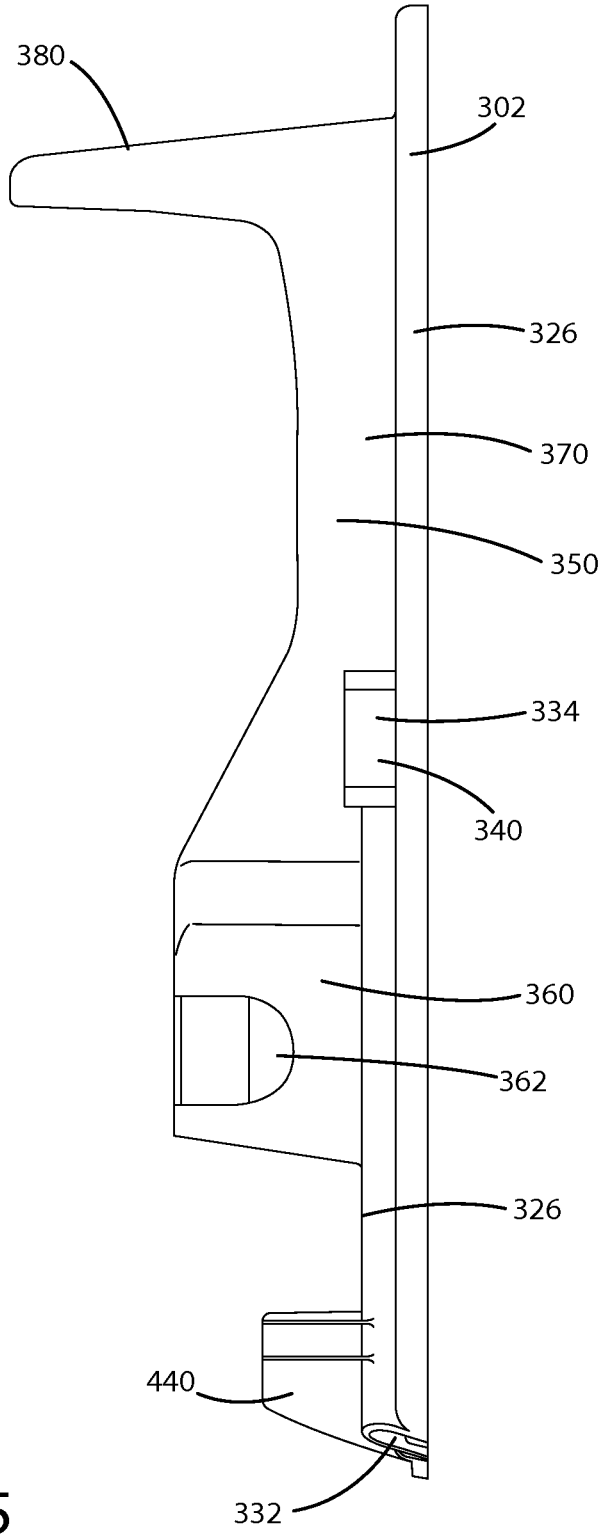
FIG. 5 is a right elevational view of the backplate.
Figure 6:
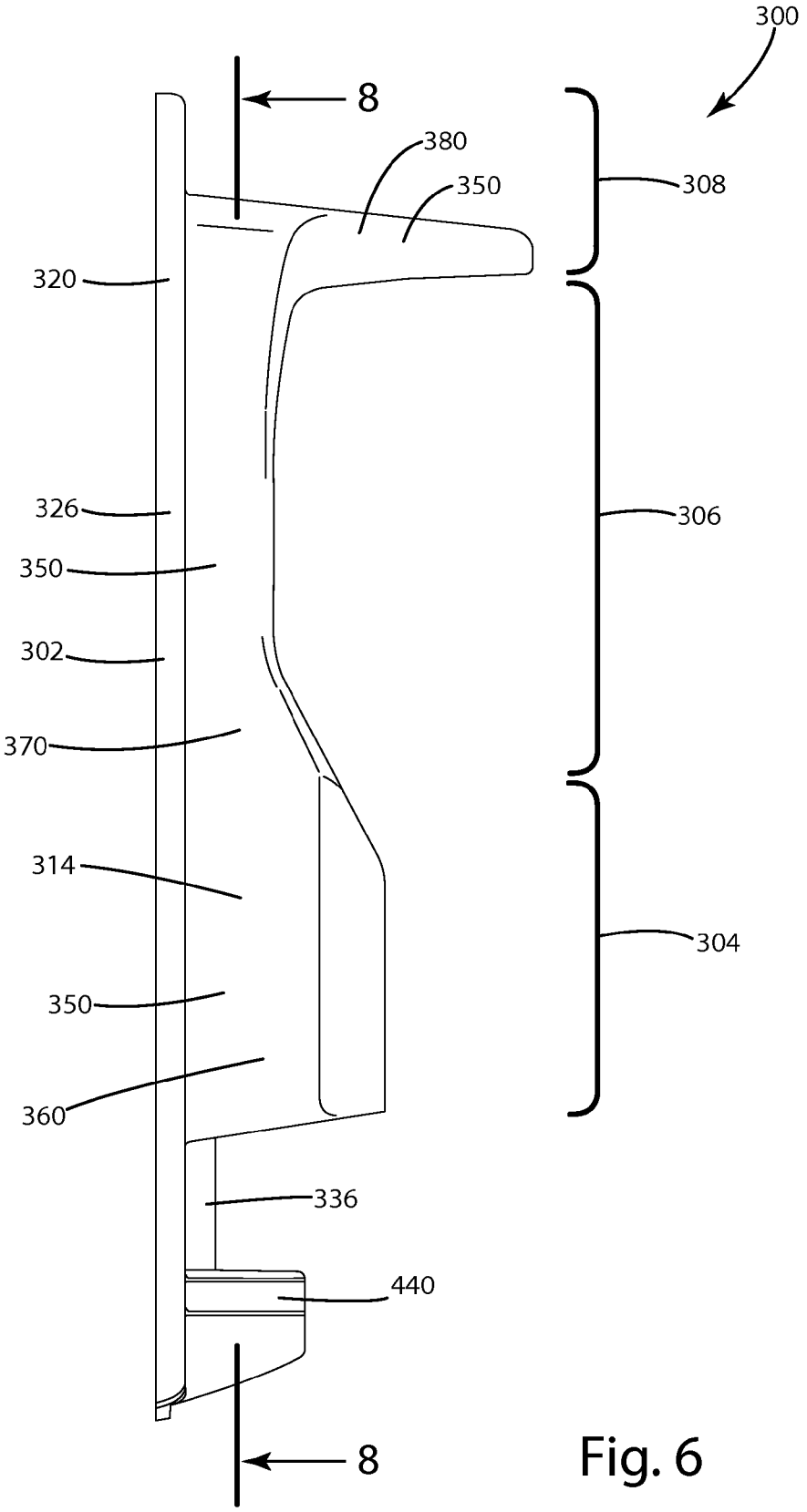
FIG. 6 is a left elevational view of the backplate.
Figure 7:
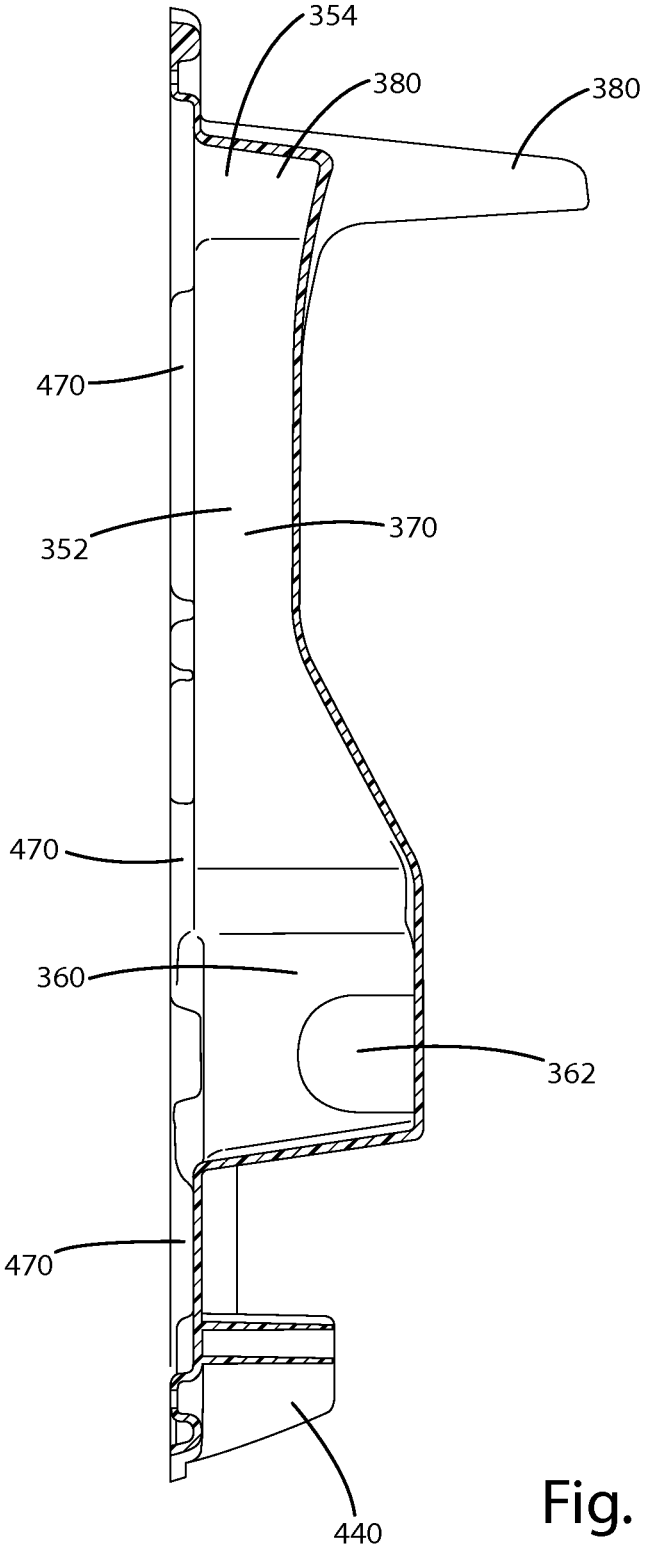
FIG. 7 is a partial cross-sectional view of the backplate along lines 7-7 in FIG. 4.
Figure 8:
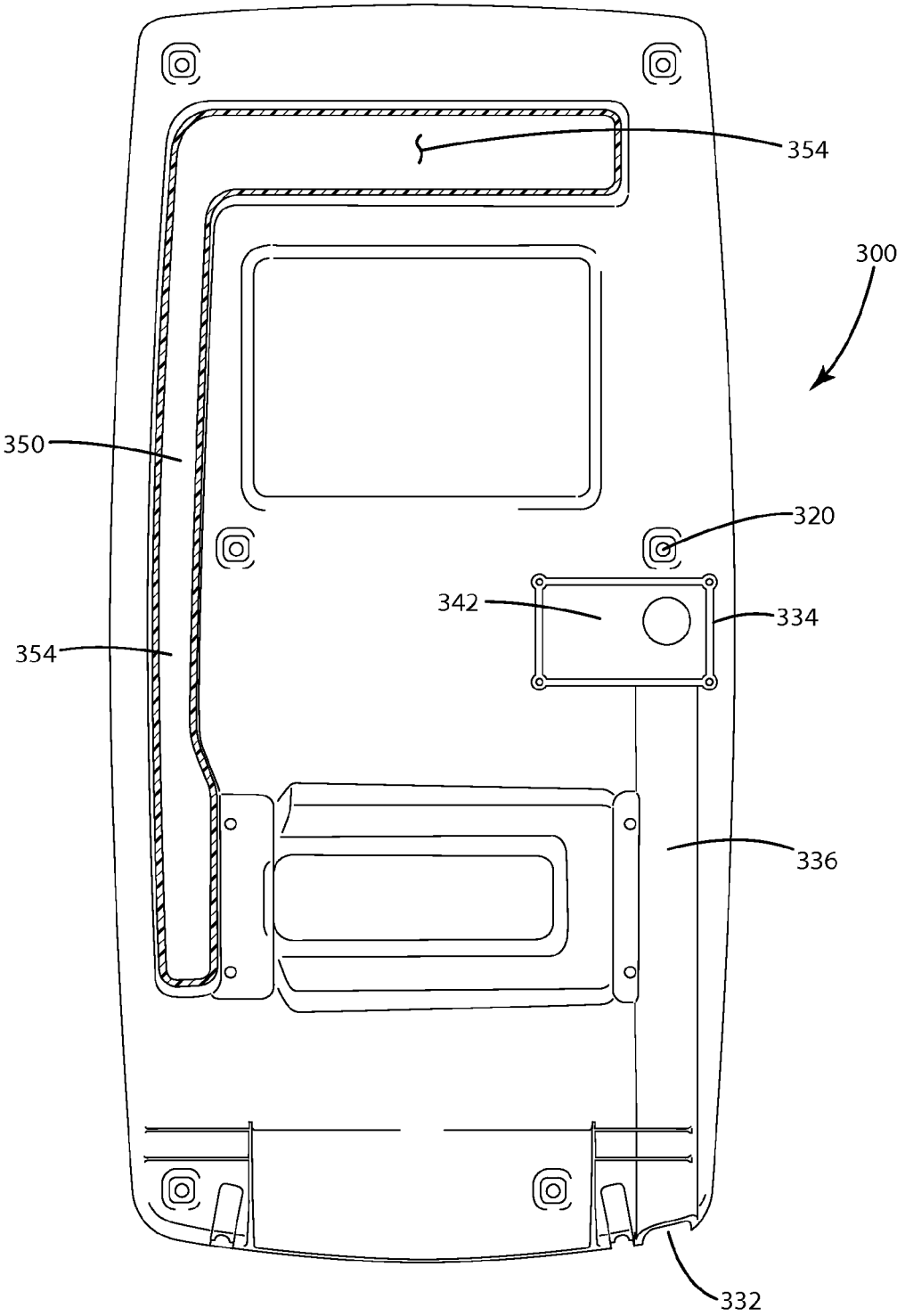
FIG. 8 is a partial cross-sectional view of the backplate along lines 8-8 in FIG. 6.
Figure 9:
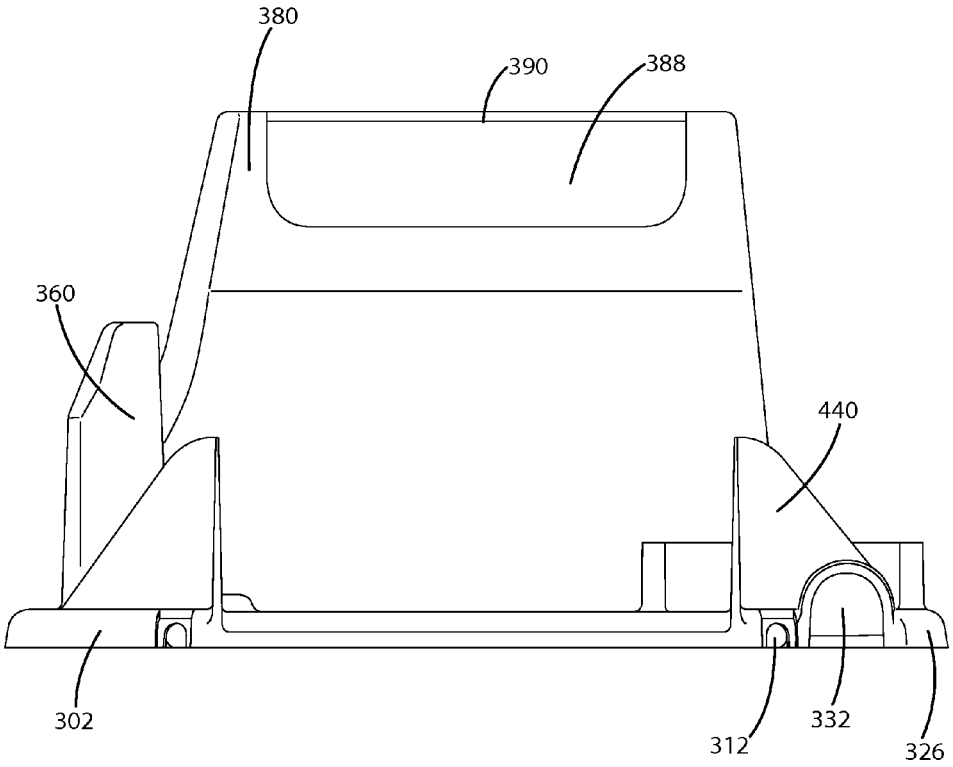
FIG. 9 is a bottom plan view of the backplate.

As illustrated in FIGS. 2 and 3, it may be seen that the backplate 300 is preferably formed as a single member including the contoured air channel 350. While the backplate 300 may be stamped from a metal sheet, it is expected that it will preferably be molded or otherwise formed from a composite material as a single member including the additional items such as the filter brackets 440 and the electrical box 334 to reduce assembly. Any suitable material that will structurally support the blower assembly 120, allow for easy molding of the air channel 350 and not detrimentally increase the sound will be suitable for use as a backplate 300.

The middle portion 306 of the backplate 300 as illustrated in the Figures includes an air passageway 370 extending between the air entrance chamber 360 and the air outlet chamber 380. As the reduction from the air entrance chamber 360 to the air passageway 370 is gradual, either the middle portion 306 may be viewed as including at least a portion of the air entrance chamber 360 or the lower portions 304 including a portion of the air passageway 370.

The middle portion 306 includes on the first surface 314, an electrical box 334 at the termination of the conduit passage 336. Electric box 334 may include a drill plate 342 on the back and walls 340. The walls 340 may extend through the first surface, causing the drill plate 342 to be recessed relative to the first surface, however it could also be aligned with the first surface. The drill plate 342 may also include a pre-drilled hole or wall passage 338. Although not illustrated, a cover may be included to be placed over the box 334. Also not illustrated, the electrical power will extend from the electrical box 334 to the blower assembly 120. The electrical box 334 may be molded as one piece with the backplate 300.

As illustrated in FIG. 3, the bulk of the backplate 300 stands proud of the supporting structure 12 such that at least a quarter inch, preferably one half inch of space, exists between the second surface 310 and the supporting structure 12. This feature is generally accomplished through the use of height locators 320, such as the attachment locators 322 and the outer lip 326. Even the back of the electrical box 334 in some instances could be a height locator 320. The height locators 320 formed by the attachment locators 322 generally include a raised surface 324 on the second surface 310. The height locator 320 formed by a lip edge 328 on the outer lip 326 cooperates with the other height locators 320 along a generally planar surface for mounting the dryer 10 evenly to the supporting structure 12. The height locator 320 set the majority of the second surface 310 spaced from the supporting structure 12. This allows for the dryer assembly 10 to be configured as a replacement dryer for existing dryers in washrooms and as such, for easy installation. More specifically, when the prior dryer being replaced was installed in the washroom, an electrical service 14 such as a direct wire or electric outlet was placed in a particular location on the supporting structure 12, specific to that prior dryer. As the new dryer 10 does not always meet the shape, style, or configuration of the existing dryer much less the identical location of the electrical power entering the dryer 10, the present invention raises the bulk of the backplate from the supporting structure to allow power to be routed from an electrical service 14 to the electrical box 334 even if the electrical service 14 is not aligned directly with the electric box 334. More specifically, by substantial portions of the backplate 300 standing proud of the supporting structure 12, the backplate 300 defines a wall cavity 470 between the supporting structure and the second surface 310. The outer lip 326 bounds the outer limits of any such wall cavity 470 and the wall cavity 470 is interrupted by an height locators 320. As illustrated in FIG. 3, the wall cavity 470 allows easy routing of electrical lines from wide areas on the backplate 300 to the electric box 334. This prevents major renovation work sometimes required in installing new dryers 10 in washrooms. As illustrated in FIG. 3, it may be seen as long as electrical service 14 is not under the blower mount area 450, easy routing of anywhere set within the outer perimeter 302 of electrical lines to the electric box 334 for an electrical service 14 is possible.

The middle portion 306 may also include a wall opening 460 which is configured to allow space for the outer shell 20, specifically for the middle portion 50 to extend as close to the wall as possible, thereby providing a deeper cavity for the user's hands and also minimizing how far the air outlet 56 must extend from the wall to provide sufficient room for the hands to be dried and for a low-profile dryer 10. The air passage 370 is generally configured to fit within the cavity formed sides 52 on the middle portion 50 of the underside of the outer shell 20.

The longitudinal portion 352 of the air channel 350 generally includes both the air entrance chamber 360 and air passageway 370. The lateral portion 354 of the air channel 350 generally includes the air outlet chamber 380. As illustrated in FIG. 2 as well as the other Figures, the lateral portion 354 generally extends substantially perpendicular from the longitudinal portion 352. It should also be noted that the lateral portion 354 forms the air outlet chamber 380 that extends substantially outward from the supporting structure 12 or backplate 300 relative to the other portions of the air channel 350. The air outlet chamber 380 generally includes an upper wall 382, a lower wall 384, a front wall 386. The front wall 386 and lower wall 384 cooperatively define an air outlet opening 388 defined by outlet edges 390. The outlet edges 390 are configured to allow for easy insertion of an air nozzle assembly 400 having an outer perimeter 402 on which grooves 404 are configured to recedingly receive the outlet edges 390. The air nozzle 400 may be formed in a variety of sizes, shapes, and configurations and include individual air outlets 406. The individual air outlets 406 may also be formed in a variety of sizes, shapes, and configurations to provide differing airflow as desired. As such, the air nozzle assembly 400 may be easily installed into the air outlet opening 388 and may also allow for easy design changes or differing air streams by simply changing or customizing the air nozzle assembly 400. For example, washrooms may have different desired airflows than other settings for the dryer. The interchangeable nozzle assembly 400 not only allows for varying air streams for drying of hands, but also may allow different functional nozzles to be installed, such as for the dryer 10 to act as a hair dryer, shoe dryer or glove dryer.

The air outlet chamber 380 is specifically configured to have a decrease in velocity of the air relative to the other portions of the air channel 350, such as through having an increased volume relative to the air passageway 370 and air inlet chamber 360. More specifically, the air outlet chamber 380 is configured to allow for a velocity of air reduction due to the expanded space relative to the air passageway 370. This drop in velocity of the air reduces the noise and as such, provides a quiet dryer 10. Of course, the air outlet chamber 380 may be formed in a variety of sizes, styles and configurations, which partially depend on the shape of the upper portion 40 of the outer shell 20.

As the backplate 300 is expected to be molded with the air channel 350 in place and the air passage cover plate 410 is installed over the channel. Although not illustrated, a gasket seal may also be used to seal the air channel 350 and prevent any air from exiting the air channel 350, other than through the air outlet 388. The air passage cover plate 410 generally includes a first extending leg 412 and a shorter lateral extending leg 414.

During operation, a user would place their hands near the middle portion 50 of the outer shell 20 at which time a sensor would instruct the air dryer to initiate its cycle. Power would be supplied from the electric box 334 to the blower assembly 120 which supplies air to the air channel from the air inlet 38 and if desired, through the optional filter 442. The blower assembly 120 is expected to be a high-speed unit and would force air through the gasket 430 into the air entrance chamber 360. The air is specifically directed against the walls 364 creating a turbulent effect and then is squeezed down through the air passage 370 increasing the velocity of the air. As the air enters the air outlet chamber 380, it expands and reduces the velocity of the air, which reduces the noise level associated with the blower assembly 120 and air being forced through the channel 350. Air then exits through the air nozzle 400 and specifically through the air outlet 56 on the outer cover or shell 20. After a certain amount of time when no hands are sensed, the dryer would cycle down.

The blower assembly as illustrated in FIG. 10 is primarily formed of a few simple components. More specifically, the blower assembly 120 generally includes a housing 140 having an end cap 250 which together define blower cavity 160. Situated within the blower cavity 160 generally rests a diffuser plate 170, a first motor mount 180, a motor assembly 200 including a blower portion 203 and a motor portion 210, a second motor mount 230 and a heater system 240. Of course, it should be recognized that the heater system 240 may be optional. In addition, the blower assembly 140 may be formed without the diffuser plate 170 and in some instances without the second motor mount 230, however, each of the items provide benefits that allow for the unique modular and easy-to-assemble as well as field service blower assembly 140 and certain performance enhancements as described in more detail below. As illustrated in FIGS. 2 and 20, it may be easily seen that the modular blower assembly 140 may be easily removed as a unit by unplugging it from the electrical box 334, removing a few fasteners that attach the mounts 148 on the blower housing 140 to the backplate 300 or as illustrated in FIG. 20, to a supporting surface 12, and replacing it with a similar unit. Therefore, instead of requiring an electrician to change out parts when they are broken, a customer may simply request a replacement blower assembly as a unit, detach as in the illustrated examples a couple of fasteners and pull the blower assembly out, removing the air outlet 260 from the compliant member 430. As discussed below, the modular nature of the blower assembly 140 even goes beyond replacement as a unit for field service but also is formed with the minimal number of fasteners and parts to allow for easy assembly, and enhanced operational performance.

To further enhance field servicing, the blower housing 140 generally includes an electronics cavity 142 defined by the outer walls 150 of the blower housing 140. The electronics cavity 140 may be configured in any size or shape but is generally configured to receive electronic members 146, such as the illustrated circuit board in FIG. 10. An electronics cavity cover plate 144 may simply cover the cavity 142 and attach by one or more fastener mechanisms. Although not illustrated, a plug may extend from the housing 140 or through the cover plate 144 making changing the blower assembly 120 as simple as unplugging a plug from the socket. Therefore, as all of the electronics 146 are concealed and not accessible when the cover plate is taken off a dryer 10, replacing the blower assembly 120 is as simple as detaching a couple of screws and unplugging a plug from the socket similar to that of a person plugging or unplugging a lamp. Of course, the housing 140 may be formed without the additional electronics cavity 142 with a plug simply running from the blower assembly to a separate and distinct electronics unit (not illustrated).

Figure 11:
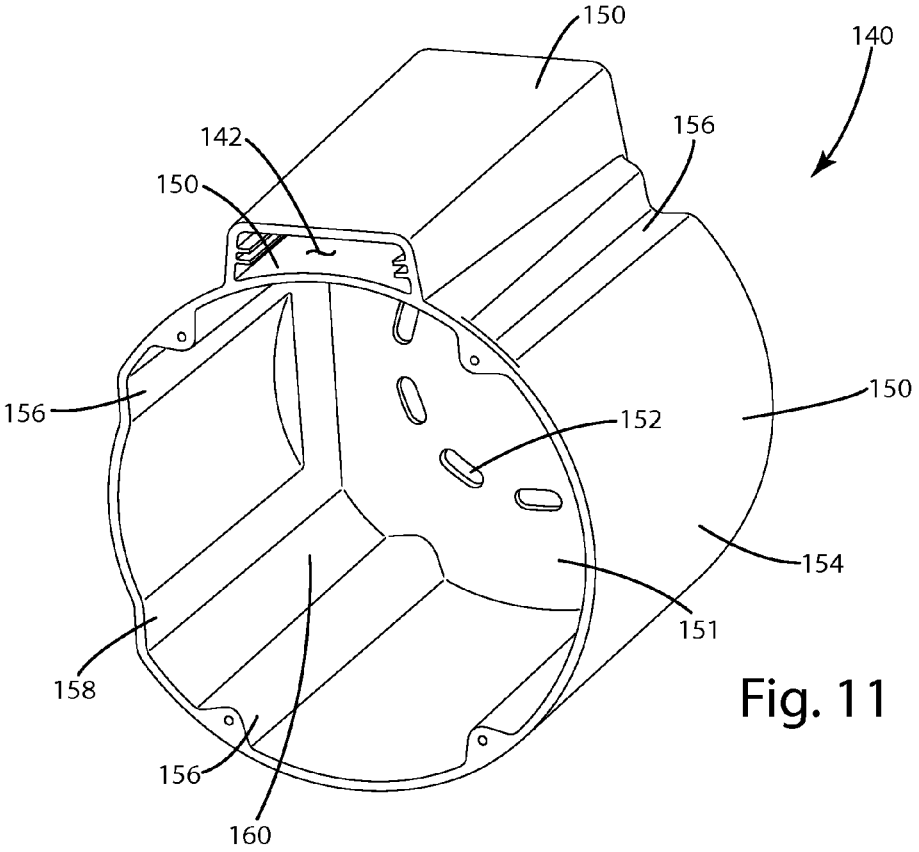
FIG. 11 is a perspective view of a blower housing.

As illustrated in the Figures, particularly FIGS. 10 and 11, the blower housing 140 generally includes an outer wall 150 having a circumferential portion 154 and a base 151. The circumferential portion 154 is generally illustrated as being substantially round to receive the substantially round motor assembly 200 particularly the round blower portion 203. As illustrated in FIGS. 10 and 11, the blower housing 140 may include a number of anti-rotation keys 156 that may engage similar anti-rotation keys on the diffuser plate 170 and motor mount 180 to prevent those items from rotating. It should be recognized that when the motor 210 and fan 208 spool up to provide air, significant counter forces are experienced and the anti-rotation keys prevent physical rotation of the motor assembly 200 relative to the housing 140. As further illustrated in FIGS. 10 and 11, the base 151 includes a number air inlets 152. The size, shape, style, location, and configuration of the air inlets 152 may vary. In some embodiments, the air inlets 152 may be formed on the circumferential portion 154.

Figure 12:
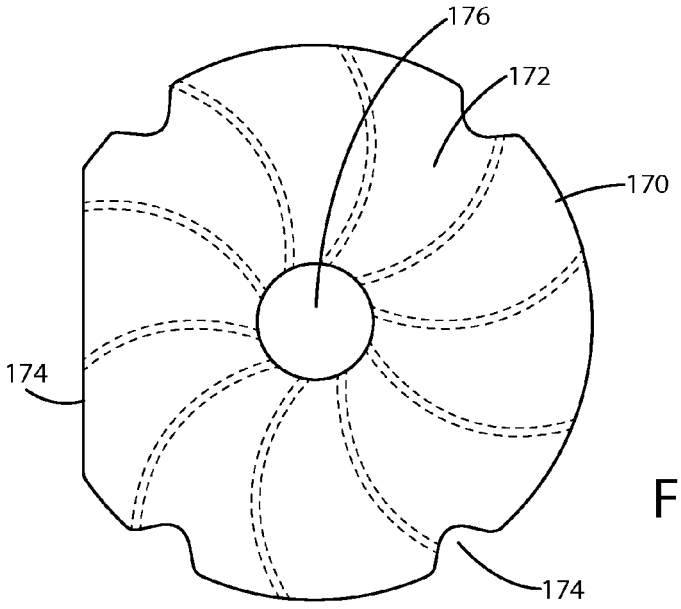
FIG. 12 is a plan view of the outlet surface of a diffuser plate.
Figure 13:
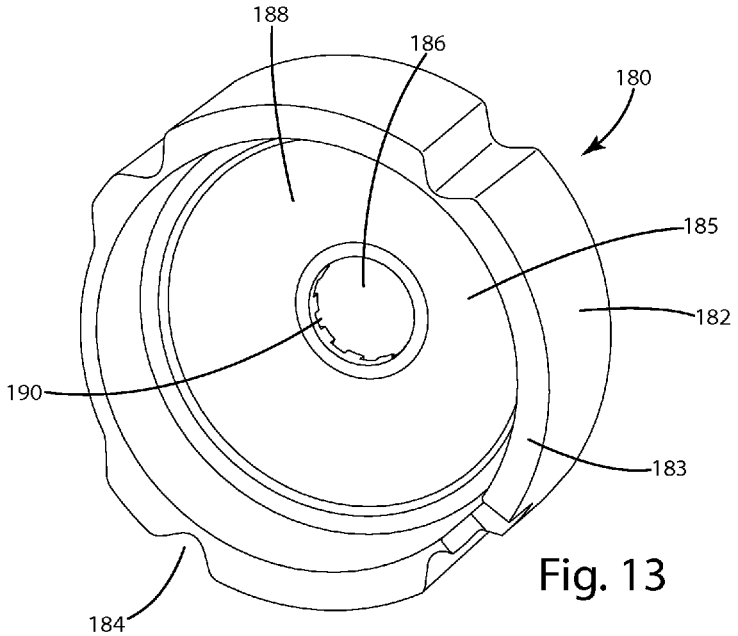
FIG. 13 is a perspective view of the outlet side of the motor mount.

A diffuser plate 170, as illustrated in FIGS. 10 and 12, is inserted first into the blower cavity 160. The diffuser plate 170 is generally configured to sit proud of the base 151 allowing sufficient spacing between the diffuser plate 170 and the air inlet 152 to allow the air to enter through the air inlets 152, pass by the diffuser plate 170 and through the diffuser passage 176. While any mechanism for making the diffuser plate 170 sit proud of the air inlets 152 may be used, it has been found particularly useful to direct the air and prevent turbulence with air directional fins 178 as best illustrated in FIG. 10. The air directional fins 178 generally include an arcuate shape and approach each other as they extend toward the diffuser passageway 176. As illustrated on the diffuser plate, a number of anti-rotation keys 174 are configured to engage the anti-rotation keys 156 on the housing 140.

Figure 15:
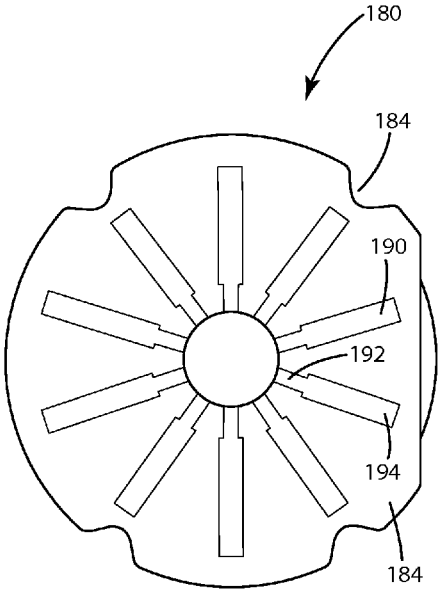
FIG. 15 is a plan view of the inlet side of the motor mount.

The blower assembly 140 uses a particularly unique first motor mount or motor mount 180 on the air intake side of the motor assembly 200. The motor mount 180 is configured to engage the diffuser plate 170 on an air intake side 181. The air intake side 181 is generally configured to rest a flat against the flat surface of the diffuser plate 170. Although the motor mount 180 may have a number of size, shapes and configurations, it generally is similar in profile to the diffuser plate 170 in that it also includes a number of anti-rotation keys 184. Of course, the motor mount does not need to match the diffuser plate 170 in profile but should include at least one anti-rotation key 184 which engages an anti-rotation key 156 on the blower housing 140. On the air intake side 181 of the first motor mount 180, at least one and preferably more Helmholtz acoustic filters or Helmholtz resonators 190 are included. The Helmholtz resonators 190, as illustrated in FIGS. 10 and 15, work in cooperation with the diffuser plate 170. The Helmholtz resonators 190 generally include a chamber 194 and a neck 192. The size of the chamber 194 and neck 192 may be changed to tune the Helmholtz resonator to counteract certain frequencies. Therefore, the Helmholtz resonator 190, which is created when the motor mount 180 is placed against the diffuser plate 170, can be configured to cancel out or reduce the volume of certain frequencies. Tuning occurs as the air passes through the diffuser passage 176 and in turn, through the air passage 186 on the motor mount 180 passes by the neck 192, creating the Helmholtz resonance. More specifically, the Helmholtz resonators are tuned to reject, cancel or reduce audible frequencies from the rotating fan blades inside the blower. These frequencies can be calculated as the rotation speed of the motor and fan multiplied by the number of fan blades. However, due to variations in motor speed from unit to unit, it is desirable to tune some of the resonators to slightly different frequencies. It is unique that the motor mount and diffuser plate work in connection to create the Helmholtz resonators 190.

Figure 14:
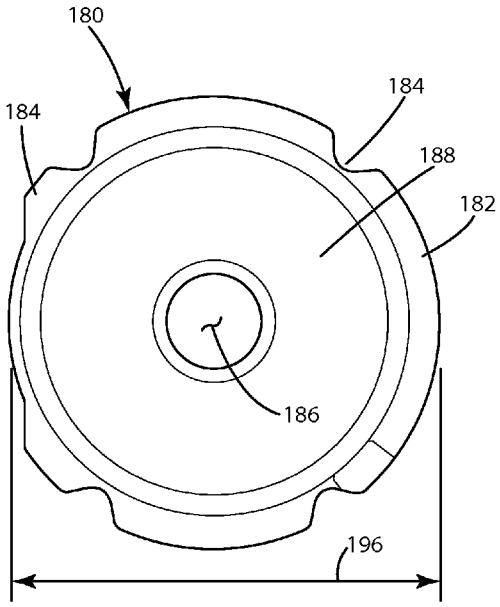
FIG. 14 is a plan view of the outlet side of the motor mount.

While the motor mount 180 may be made as a flat member, as illustrated in FIGS. 10 and 13-15 the motor mount 180 may have a more three-dimensional shape. More specifically, the motor mount 180 may be formed with an outer rim 182 which defines the motor mount cavity 188. The motor mount cavity 188 may be configured to receive a portion of the fan or the blower portion 203. As the motor mount 180 is generally formed from a compliant material, it is configured to seal against the fan portion somewhere in the region of the base or flat portion 185 proximate to the air passage 186 formed therein. The outer rim 182 by extending around at least a portion of the lower portion 203 and being formed from a compliant material provides an insulating effect. One of the largest noise components of a high-speed dryer 10 is the rotation of the fan 208 within the fan housing 204, which in combination form the blower portion 203 of the motor assembly 200. While not necessary, the outer rim 182 provides a sound dampening effect by surrounding the blower portion 203. The outer rim 182 can extend for the length of the whole blower portion to maximize the insulating, specifically an acoustic insulating effect described above. As illustrated in FIG. 14, the motor mount 180 may generally have an outer diameter 196. The motor mount may be formed from an injection molded material or other compliant materials, such as rubber, silicone, urethane. The above materials are only exemplary any material that can form an air seal under compression and operate in the desired temperature range may be used. The material should be flame retardant and it is helpful for the material to have dampening and acoustic insulating properties.

Figure 16:
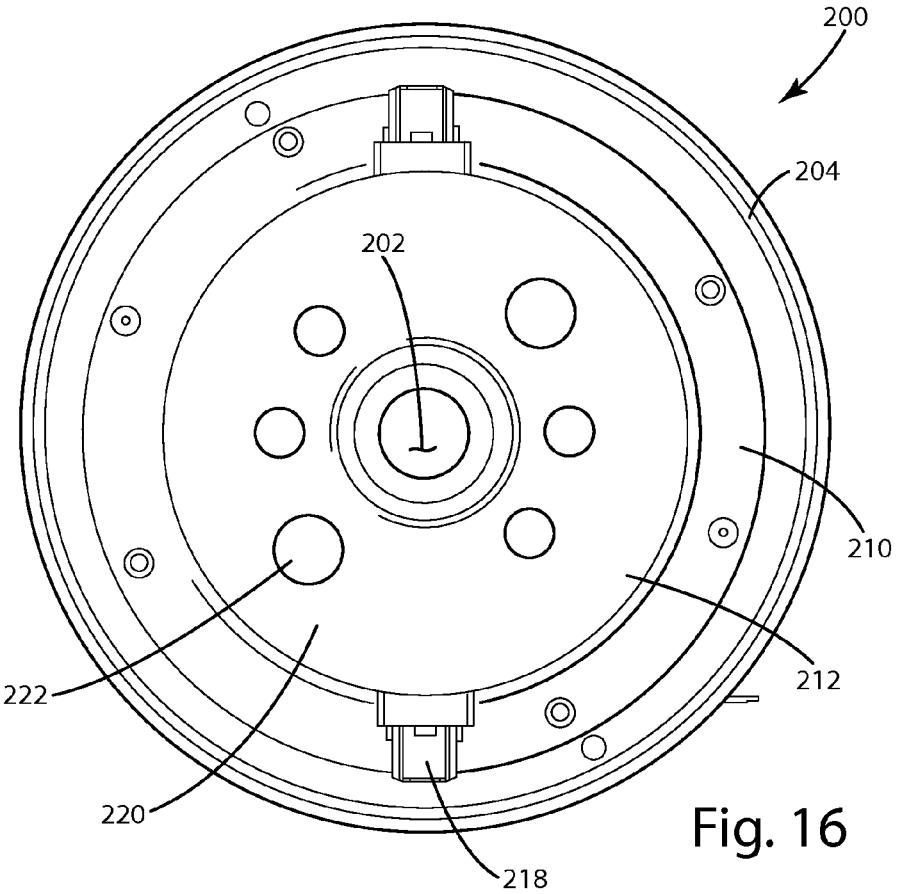
FIG. 16 is a plan view of the outlet side of the motor assembly.

The motor assembly 200 generally includes a motor portion 210 and a blower portion 203. The motor portion 210 drives the blower portion which is generally a fan 208 in a fan housing 204. The motor assembly 200 may be best illustrated in FIGS. 10 and 16. The motor assembly 200 intakes air through the housing air inlet 206 and compresses it into the motor portion 210. Air then exits through air outlets 216 on the motor portion 210. The motor assembly 200 may generally be considered to have an outer casing which may be formed of multiple portions and cover the blower portion 203 and motor portion 210. The outer casing 212 defines the air inlet 206 as well as the air outlet 216. As illustrated in FIG. 10, an electrical connector 218 may be included on the outer casing 212. The outer casing 212 on the motor portion 210 generally defines one or more air outlets 216. The air outlets 216 extend on the circumferential surface of the motor portion 210 and air is taken in through the air inlet 206 which is aligned with the operational axis or rotational axis 202. The air, after being compressed and being forced into the motor portion 210, exits from the air outlets 216 outwardly away from the operational axis 202. The term "compressed" is used loosely as the fan 208 in pushing air to the smaller motor portion 210 increases the pressure of the air in the motor portion relative to the incoming air. More specifically, the air is compressed inside the blower housing and air chambers to a pressure of approximately one to two PSIG. The pressure differential between the air in the dryers air chambers and the ambient air along with the effective cross sectional opening of the outlet nozzle is used to determine the velocity of the air existing the nozzle to dry the users hands It should be noted that the outer casing, particularly the circumferential surface 214, does not include the illustrated embodiment in FIG. 10 as well as FIG. 16, any anti-rotation keys. By separating the motor assembly 200 from the housing 140, vibrations created by the motor assembly 200 are not directly transmitted to the housing 140 but instead must pass through two compliant members which are the first motor mount 180 and the second motor mount 230 as described below. While the motor assembly 200, particularly on the fan portion or blower portion 203, specifically the fan housing 204, sealingly engages the first motor mount 180, it is desirable to provide further resistance against rotation particularly during startup of the motor assembly 200. As such, as described in more detail below, the outer casing 212 includes on a base 220, anti-rotation keys 222 which interact with the second motor mount 230. It is important to note that the first motor mount 180 is configured to provide a substantially air tight seal between the air inlet 206 on the blower portion 203 and the air outlets 216 on the motor portion 210. Therefore, the motor mount 180 is used to separate the air inlets from the air outlets within the blower housing 140. In addition, the motor mount 180 when placed in compression by the motor assembly after assembling into the blower housing 140 may be configured such that the outer rim 182 sealingly engages at least substantially sealingly engages the interior of the blower cavity 160, particularly the circumferential portion 154. The motor assembly 200 is configured such that the air passing through provides a cooling effect and strips heat from the motor assembly.

The second motor mount or outlet motor mount 230 generally has a diameter 232 which is smaller than the diameter 196 of the first motor mount. The smaller diameter allows the air to pass by the outside surfaces of the second motor mount 230. The second motor mount 230 includes unique anti-rotation keys 236 which engage the anti-rotation keys 222 on the base 220 of the motor assembly 200. While the anti-rotation keys 236 are illustrated as a plurality of raised circles, any type of size, shape or configuration of anti-rotation keys that match or mate with the anti-rotation keys 222 on the motor assembly 200 may be used. The second motor mount 230 is generally formed from a compliant material similar to that of the first motor mount 180. While the motor mount 230 does include a passage 234 aligned with the operational axis 202 for the illustrated motor assembly 200, air does not substantially pass through this passage 234. Instead, the bulk of the air passes around the outside of the second motor mount 230.

Figure 17:
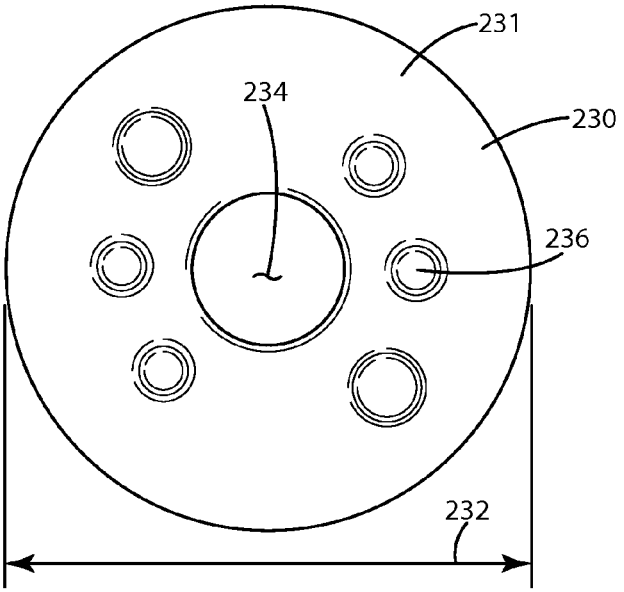
FIG. 17 is a plan view of the inlet side of a second motor mount.
Figure 18:
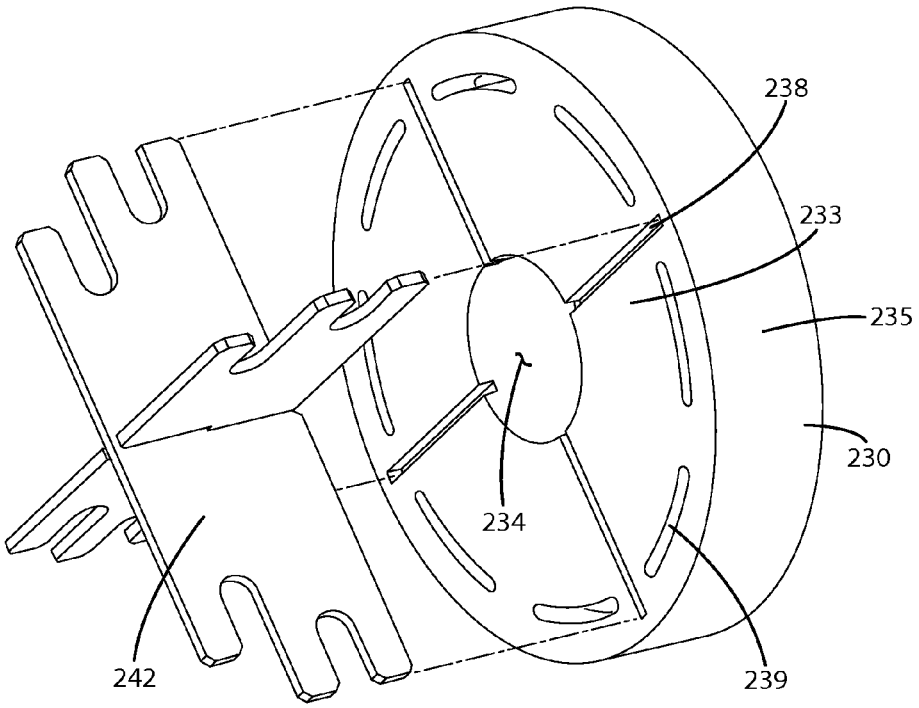
FIG. 18 is a perspective view of the outlet side of the second motor mount and heater element supports.
Figure 19:
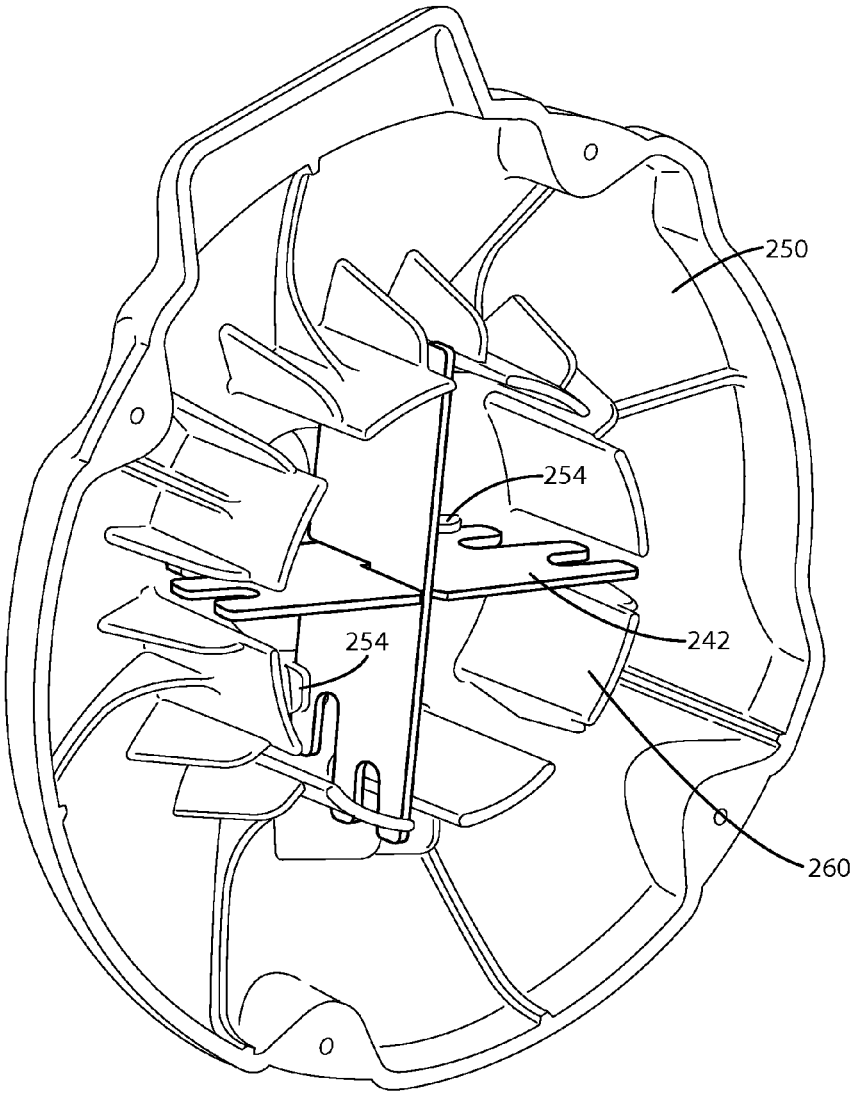
FIG. 19 is an inlet side perspective view of the housing end cap and heater element supports.

The second motor mount 230 may be divided into an air intake surface or side 231 and an air outlet surface or side 233 joined by a circumferential edge 235. As illustrated in the FIGS. 10 and 17, the air intake surface or side 231 generally includes the anti-rotation keys 236. As illustrated in FIG. 18, the air outlet side 233 may include a variety of features helpful to prevent the second motor mount 238 from rotating as well as support various other systems within the blower assembly 120. More specifically, as illustrated in FIG. 18, a variety of slots 239 may be configured to engage and receive protrusions 262 from the housing end cap 250. The slots 239 may be configured in a variety of sizes, shapes, or other configurations and do not need to necessarily extend circumferentially around the outside edge near the circumferential edge 235. The slots 239 are configured to be anti-rotation such that the housing end cap 250 secures the second motor mount 230 from rotating relative to the housing 140, preventing the second motor mount 230 from rotating in turn helps prevent the motor assembly 200 from rotating due to the interaction of the anti-rotation keys 236 and 222. The housing end cap 250 when secured to the housing 140 generally places the first motor mount 180 and second motor mount 230 in compression. More specifically, the protrusions 260 on the housing end cap 250 engage the slots 239 on the second motor mount 230 yet compress the second motor mount 230 against the motor assembly 200 which in turn is compressed against the first motor mount 180. The first and second motor mounts 190, 230 cooperate to prevent the blower assembly 200 from rotating relative to the housing 140 and yet keep the motor assembly 200 isolated from the housing 140 to prevent transmission of vibrations and thereby noise.

As further illustrated in FIG. 18, the second motor mount 230 may include heater support slots 238 to receive the heater system 240. The heater system 240 generally includes a coil of wires (not shown) that are wrapped around the heater support elements 242. The heater support elements are typically made of a type of mica and are very fragile and therefore it is beneficial to mount them in a compliant material such as the motor mount 230.

The housing end cap is illustrated in FIGS. 2, 10, 19 and 20 and generally includes a reducing neck 252 that has an air outlet 260 that is placed into compliant member 430 such as illustrated in FIG. 2 or a tubing such as illustrated in FIG. 20. Upon assembly, the housing end cap is secured to the blower housing 140 and compresses the first and second motor mounts 180, 230.

During assembly, a worker would assemble the electronics components 146 into an electronics cavity 142. As stated above, the housing 140 may include the electronics cavity 142 or the electronics may be placed separately. To provide a modular replaceable field unit that is easily swapped, it is expected that most of the times the blower housing 140 will be configured to include the electronics cavity 142 such that the person field servicing only needs to replace a single part under the cover of the dryer 10, specifically the whole blower assembly. A diffuser plate 170 is placed into the blower cavity 160 followed by a motor mount 180. Next, the motor assembly 200 is placed against the motor mount 180 typically fitting within a cavity 188 on the motor mount 180. Next, the second motor mount 230 is assembled such that the anti-rotation keys 236 engage the anti-rotation keys 222 on the motor assembly 200. The heater system 240 is placed within the blower cavity and the housing end cap 250 is secured to the blower housing 140 and as it is fastened together places the first and second motor mounts 180, 230 in compression. As seen, the elements of the present invention work together to provide an easy assembly as well as a modular blower assembly 120 that may be used in a variety of units by simply placing the whole assembly 120 into position. While the dryer 10 illustrated in FIGS. 1 and 20 provide easy ways or unique ways to secure the blower housing 140 to a supporting structure 12, the blower assembly 120 may be used in a variety of other dryers having different sizes, shapes and configurations.

The invention claimed is:

1. A blower assembly for a dryer assembly configured to dry hands, said blower assembly comprising:

a blower housing having a base and an outer wall collectively defining a blower cavity with a blower cavity diameter, and wherein said blower cavity is substantially aligned along on operational axis, and wherein said housing includes at least one air inlet;

a motor mount having a motor mount diameter and wherein said motor mount is configured to be received in said blower cavity and includes at least one Helmholtz resonator; and a motor assembly including a motor and a blower and wherein said motor and blower are at least partially enclosed in an outer casing having an air inlet and an air outlet and wherein said outer casing sealingly engages said motor mount between said air outlet and said air inlet.

2. The blower assembly of claim 1 wherein said motor mount is approximately equal to and less than said blower cavity diameter.

3. The blower assembly of claim 1 further including a diffuser plate between said base and said motor mount, and wherein said diffuser plate includes directional air fins.

4. The blower assembly of claim 3 wherein a plurality of said directional air fins each includes at least one arcuate profile.

5. The blower assembly of claim 3 wherein said diffuser plate includes a diffuser passage aligned substantially about said operation axis.

6. The blower assembly of claim 1 wherein said motor mount is formed from a compliant material.

7. The blower assembly of claim 1 wherein in an assembled state said motor assembly is mounted in compression against said motor mount in said blower housing.

8. The blower assembly of claim 7 wherein in said assembled state, said motor mount engages a diffuser plate on a first side and said motor assembly on an opposing second side and wherein said motor mount includes an outer circumferential surface engaging said blower housing.

9. The blower assembly of claim 1 wherein said motor mount includes a motor mount air passage substantially aligned along said operational axis.

10. The blower assembly of claim 1 wherein said motor mount includes at least six Helmholtz resonators, each extending radially outward from said operational axis.

11. The blower assembly of claim 1 wherein each Helmholtz resonator includes a neck and a chamber and wherein said neck opens to a motor mount air passage aligned with said operational axis.

12. The blower assembly of claim 1 wherein said air inlet is arranged along said operation axis and said air outlet is defined by openings on said outer casing and wherein said air exits through said air outlets, flowing outwardly away from operational axis.

13. The blower assembly of claim 1 wherein said motor assembly is configured to pull air through the air inlet along said operational axis, compress the air through a motor portion on the motor assembly and expel the air outwardly away from the operational axis.

14. The blower assembly of claim 1 wherein said outer casing includes a motor portion and a blower portion and wherein said motor mount sealing engages said blower portion and wherein said motor portion includes at least one motor assembly anti-rotation key.

15. The blower assembly of claim 14 further including an outlet motor mount and wherein said outlet motor mount includes a motor mount anti-rotation key configured to engage said motor assembly anti rotation key.

16. The blower assembly of claim 15 wherein said outlet motor mount is held in compression against said outer casing.

17. The blower assembly of claim 1 further including an outlet motor mount and a housing end cap and wherein said housing end cap includes protrusions engaging recesses on said outlet motor mount and wherein said housing end cap is configured to prevent said outlet motor mount from rotating relative to said blower housing and wherein said outlet motor mount is configured to prevent said motor assembly from rotating relative to said blower housing.

18. The blower assembly of claim 1 further including a housing end cap configured to be coupled to said blower housing and wherein said housing end cap includes an end cap air outlet, and wherein said blower housing is capable of being coupled to an end cap and wherein said motor assembly is not directly coupled to said blower housing.

19. The blower assembly of claim 18 further including an end cap and an outlet motor mount and wherein said motor assembly is coupled to said blower housing solely by being held in compression between said motor mount and said outlet motor mount.

20. The blower assembly of claim 18 wherein said outer casing is free of external attachment mechanisms, and said motor mount is free of attachment mechanisms.

21. The blower assembly of claim 1 wherein said motor mount is not coupled to said blower housing with attachment mechanisms.

22. The blower assembly of claim 1 wherein said motor mount is compressed in an assembled state and wherein in said assembled state, said motor mount engages said blower housing in a friction fit.

23. The blower assembly of claim 1 wherein said motor mount includes an air inlet side and an air outlet side and wherein said motor mount on said air outlet side defines a cavity capable of receiving a portion of said motor assembly.

24. The blower assembly of claim 23 wherein said cavity is defined by sidewalls, and wherein said motor assembly includes a blower portion and a motor portion and wherein said sidewalls extend between said blower portion and said blower housing.

25. The blower assembly of claim 1 further including an air outlet motor mount and wherein said air outlet motor mount does not engage said blower housing.

26. The blower assembly of claim 25 wherein said air outlet motor mount directly engages said motor assembly, a housing end cap and a heater element holder located between said air outlet motor mount and said housing end cap.

27. The blower assembly of claim 1 further including a housing end cap coupled to said blower housing and wherein said housing end cap includes a plurality of protrusions, each having a gap between two adjoining protrusions.

28. The blower assembly of claim 1 further including a backplate and wherein said blower housing is coupled to said backplate and an air outlet extends into said backplate.

29. A blower assembly for a dryer assembly configured to dry hands, said blower assembly comprising:

a blower housing having a base and an outer wall collectively defining a blower cavity with a blower cavity diameter, and wherein said blower cavity is substantially aligned along on operational axis, and wherein said base includes at least one air inlet;

a motor mount having a motor mount diameter and wherein said motor mount is configured to be received in said blower cavity and includes at least one Helmholtz resonator; and a motor assembly having outer casing defining air inlet and an air outlet and wherein said motor assembly is isolated from said blower housing and does not directly contact said blower housing.

30. The blower assembly of claim 29 further including a second motor mount and wherein said first motor mount and said second motor mount are located on opposing ends of said motor assembly and aligned with said operational axis.

31. A blower assembly for a dryer assembly configured to dry hands, said blower assembly comprising:

a blower housing having a base and an outer wall collectively defining a blower cavity with a blower cavity diameter, and wherein said blower cavity is substantially aligned along on operational axis, and wherein said base includes at least one air inlet;

a motor mount having a motor mount diameter and wherein said motor mount is configured to be received in said blower cavity and wherein said motor mount includes a motor mount passage and at least one Helmholtz resonator;

a diffuser plate between said base and said motor mount and wherein said diffuser plate includes a diffuser passage aligned with said motor mount passage;

a motor assembly having outer casing defining air inlet and an air outlet and wherein said air inlet is aligned with said motor mount passage; and a second motor mount located on an opposing side of said motor assembly from said motor mount.

* * * * *